US008743040B2

(12) United States Patent
Ooishi et al.

(10) Patent No.: US 8,743,040 B2
(45) Date of Patent: Jun. 3, 2014

(54) LIQUID CRYSTAL DISPLAY DEVICE WITH CORRECTION UNIT TO GENERATE CORRECTION GRAY LEVEL SIGNAL VOLTAGES

(75) Inventors: Yoshihisa Ooishi, Yokohama (JP); Masato Ishii, Tokyo (JP); Junichi Maruyama, Mobara (JP); Goki Toshima, Chiba (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 530 days.

(21) Appl. No.: 13/050,983

(22) Filed: Mar. 18, 2011

(65) Prior Publication Data

US 2011/0234649 A1 Sep. 29, 2011

(30) Foreign Application Priority Data

Mar. 23, 2010 (JP) ..... 2010-067063

(51) Int. Cl.
*G09G 3/36* (2006.01)

(52) U.S. Cl.
USPC ..... 345/89

(58) Field of Classification Search
USPC ..... 345/87, 88, 89
See application file for complete search history.

(56) References Cited

U.S. PATENT DOCUMENTS

| | | | | |
|---|---|---|---|---|
| 6,529,180 | B1 * | 3/2003 | Ito et al. | 345/89 |
| 7,602,361 | B2 * | 10/2009 | Aoki | 345/89 |
| 8,446,352 | B2 * | 5/2013 | You | 345/89 |
| 2001/0005193 | A1 * | 6/2001 | Yokoyama | 345/92 |

(Continued)

FOREIGN PATENT DOCUMENTS

| | | |
|---|---|---|
| JP | 2005-107531 | 4/2005 |
| JP | 2005-140883 | 6/2005 |

(Continued)

OTHER PUBLICATIONS

Japanese Office Action in corresponding Appln No. 2010-067063, dated Jul. 2, 2013 with English translation.

*Primary Examiner* — Chanh Nguyen
*Assistant Examiner* — Roy Rabindranath
(74) *Attorney, Agent, or Firm* — Antonelli, Terry, Stout & Kraus, LLP.

(57) ABSTRACT

A liquid crystal display device which includes one image signal line which is connected to a plurality of pixels, a scanning line drive part which outputs an ON voltage to the respective pixels in a predetermined order, and a data line drive part which outputs image signal voltages. The data line drive part outputs a gray level signal voltage corresponding to a gray level value of the pixel as an image signal voltage in a first period, and outputs a correction gray level signal voltage different from the gray level signal voltage as an image signal voltage in a second period which precedes the first period. The liquid crystal display device further includes a control part which generates the correction gray level signal voltage based on the gray level value of the pixel and one or plurarity of gray level values of pixels which precede the pixel in order.

9 Claims, 18 Drawing Sheets

(56) References Cited

U.S. PATENT DOCUMENTS

| | | | | |
|---|---|---|---|---|
| 2002/0044123 | A1* | 4/2002 | Aoki | 345/89 |
| 2004/0090405 | A1* | 5/2004 | Izumi | 345/87 |
| 2004/0183761 | A1* | 9/2004 | Miyachi et al. | 345/87 |
| 2005/0068343 | A1 | 3/2005 | Pan et al. | |
| 2005/0162359 | A1 | 7/2005 | Sugino | |
| 2005/0200631 | A1 | 9/2005 | Pan et al. | |
| 2007/0046609 | A1 | 3/2007 | Lee | |
| 2009/0051694 | A1 | 2/2009 | Pan et al. | |
| 2009/0102766 | A1 | 4/2009 | Oke et al. | |

FOREIGN PATENT DOCUMENTS

| | | |
|---|---|---|
| JP | 2007-65657 | 3/2007 |
| JP | 2008-083286 | 4/2008 |
| JP | 2008-209890 | 9/2008 |
| WO | WO 03/098588 | 11/2003 |

* cited by examiner

LIQUID CRYSTAL DISPLAY DEVICE WITH CORRECTION UNIT TO GENERATE CORRECTION GRAY LEVEL SIGNAL VOLTAGES

CROSS-REFERENCE TO RELATED APPLICATION

The present application claims priority from Japanese application JP 2010-067063 filed on Mar. 23, 2010, the content of which is hereby incorporated by reference into this application.

BACKGROUND OF THE INVENTION

1. Field of the Invention

The present invention relates to a liquid crystal display device.

2. Description of Related Art

When a liquid crystal display device is drived at a high refresh rate, a time in which an image signal is inputted to a pixel electrode is short, hence a potential of the pixel electrode does not reach a desired potential thus causing the deterioration of image quality as a result.

In view of the above, in JP 2008-209890 A, an attempt has been made to suppress the deterioration of image quality using a following method. That is, firstly, a voltage obtained by adding a preset voltage to a gray level voltage corresponding to a gray level value is inputted to a pixel electrode as an image signal in one horizontal period (or a 1 H period) and, thereafter, the gray level voltage per se is inputted to the pixel electrode as an image signal. This driving method is referred to as a precharge.

SUMMARY OF THE INVENTION

However, recent years have seen the advent of a liquid crystal display device in which liquid crystal is driven at a high speed such as a double speed (120 Hz) or a quadruple speed (240 Hz), for example. In such a liquid crystal display device, 1 horizontal period becomes short so that a time for writing a signal into a pixel electrode becomes short whereby it is necessary to perform a precharge more efficiently.

Accordingly, it is an object of the present invention to provide a technique which can more surely suppress the deterioration of image quality when a liquid crystal display device is driven at a high refresh rate.

In view of the above-mentioned object, according to one aspect of the present invention, there is provided a liquid crystal display device which includes: a plurality of pixels each of which includes a pixel electrode and a thin film transistor which has a source electrode thereof connected to the pixel electrode; one image signal line to which drain electrodes of the thin film transistors included in the plurality of respective pixels are connected; an output unit which outputs an ON voltage for turning on the thin film transistors included in the pixels respectively to gate electrodes of the thin film transistors in a predetermined order for every pixel; and an image signal output unit which outputs an image signal voltage corresponding to the pixel through the image signal line for every pixel in the predetermined order; wherein the image signal output unit outputs a gray level signal voltage having a voltage corresponding to a gray level value of the pixel as an image signal voltage for the pixel in a first period out of a period in which the image signal voltage of the pixel is outputted, and outputs a correction gray level signal voltage having a voltage different from the gray level signal voltage as an image signal voltage of the pixel in a second period which precedes the first period out of the period, and the liquid crystal display device further includes a control unit which generates the correction gray level signal voltage for the pixel based on the gray level value of the pixel and one or plurality of gray level values of pixels which precede the pixel in order.

Further, according to one mode of the liquid crystal display device according to the present invention, the control unit may generate the correction gray level signal voltage of the pixel based on the plurality of gray level values of pixels which precede the pixel in order including two pixels consisting of a one-pixel preceding pixel and a two-pixel preceding pixel.

Further, according to another mode of the liquid crystal display device according to the present invention, the output unit may start the outputting of the ON voltage for turning on the thin film transistor included in the pixel when the image signal voltage corresponding to a pixel which precedes the pixel by one or more pixels in order is outputted from the image signal output unit.

Further, according to another mode of the liquid crystal display device according to the present invention, the control unit may include: a correction unit which outputs a correction gray level value based on the gray level value of the pixel and the one or plurality of a gray level values of pixels which precede the pixel in order; and a correction gray level signal voltage generation unit which generates the correction gray level signal voltage based on the correction gray level value outputted from the correction unit.

Further, according to another mode of the liquid crystal display device according to the present invention, the correction unit may output the correction gray level value of the pixel based on the gray level value of the pixel, a gray level value of a one-pixel preceding pixel before the pixel in order and a correction gray level value of the one-pixel preceding pixel before the pixel in order, and the correction gray level value of the one-pixel preceding pixel before the pixel in order may be outputted based on at least two of gray level values of pixels consisting of the one-pixel preceding pixel before the pixel in order and a two-pixel preceding pixel before the pixel in order.

Further, according to another mode of the liquid crystal display device according to the present invention, the correction unit may output a correction amount based on the gray level values of a one-pixel preceding pixel and a two-pixel preceding pixel before the pixel in order by referencing a first lookup table in which the gray level values of the one-pixel preceding pixel and the two-pixel preceding pixel before the pixel in order and the correction amount are associated with each other, the correction unit may also output the correction gray level value of the pixel by referencing a second lookup table in which the gray level value of the pixel, the correction amount and the correction gray level value of the pixel are associated with each other, and the correction amount may be smaller than the correction gray level value of the pixel in data size.

Further, according to another mode of the liquid crystal display device according to the present invention, the liquid crystal display device may further include a detection unit which detects a potential written in the pixel electrode, wherein the control unit may generate the correction gray level signal voltage of the pixel based on the gray level value of the pixel and a potential written in the pixel electrode of a one-pixel preceding pixel before the pixel in order.

Further, according to another mode of the liquid crystal display device according to the present invention, the correction unit may include an estimation unit which estimates a potential written in the pixel electrode of the pixel based on the gray level value of the pixel and the correction gray level value of the pixel, and the correction unit may generate the correction gray level value of the pixel based on the gray level value of the pixel and a potential of a one-pixel preceding pixel before the pixel in order which has the potential estimated by the estimation unit.

Further, according to another mode of the liquid crystal display device according to the present invention, the estimation unit may estimate the potential written in the pixel electrode of the pixel by referencing a lookup table in which the gray level value of the pixel, the correction gray level value of the pixel and the potential written in the pixel electrode of the pixel are associated with each other.

Further, according to another mode of the liquid crystal display device according to the present invention, the control unit may generate the correction gray level signal voltage of the pixel based on a result of comparison between the gray level value of a one-pixel preceding pixel before the pixel in order and the potential written in the pixel electrode of the one-pixel preceding pixel before the pixel in order.

Further, according to another mode of the liquid crystal display device according to the present invention, the control unit may generate the correction gray level signal voltage by referencing at least one lookup table, and the control unit may include an updating unit which updates the lookup table based on the result of the comparison.

According to the present invention, it is possible to suppress the deterioration of image quality in a more reliable manner when a liquid crystal display device is driven at a high refresh rate.

DETAILED DESCRIPTION OF THE INVENTION

Hereinafter, respective embodiments of the present invention are explained in detail in conjunction with drawings.

First Embodiment

Figure 1:
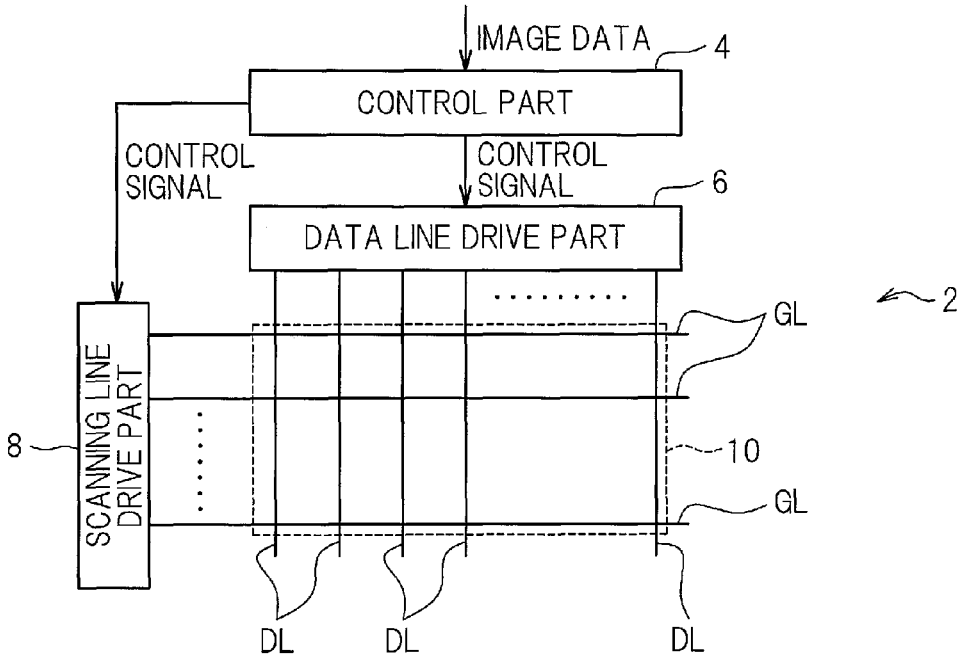
FIG. 1 is a constitutional view of a liquid crystal display device according to a first embodiment of the present invention.

FIG. 1 is a constitutional view of a liquid crystal display device 2 according to a first embodiment of the present invention. The liquid crystal display device 2 includes a liquid crystal panel, a backlight, and a storage unit such as a line memory. Further, the liquid crystal panel includes a first substrate, a second substrate, and a liquid crystal layer which is sealed in a gap defined between both substrates. On the first substrate, a control part 4, a data line drive part 6, a scanning line drive part 8, a plurality of data lines DL which are connected to the data line drive part 6, and a plurality of scanning lines GL which are connected to the scanning line drive part 8 are formed.

The liquid crystal display device 2 is realized as a liquid crystal display which adopts an IPS (In-Plane Switching) mode as a display mode, for example. In this embodiment, the liquid crystal display device 2 displays an image at a refresh rate which is selected by a user from a plurality of refresh rates.

Figure 2:
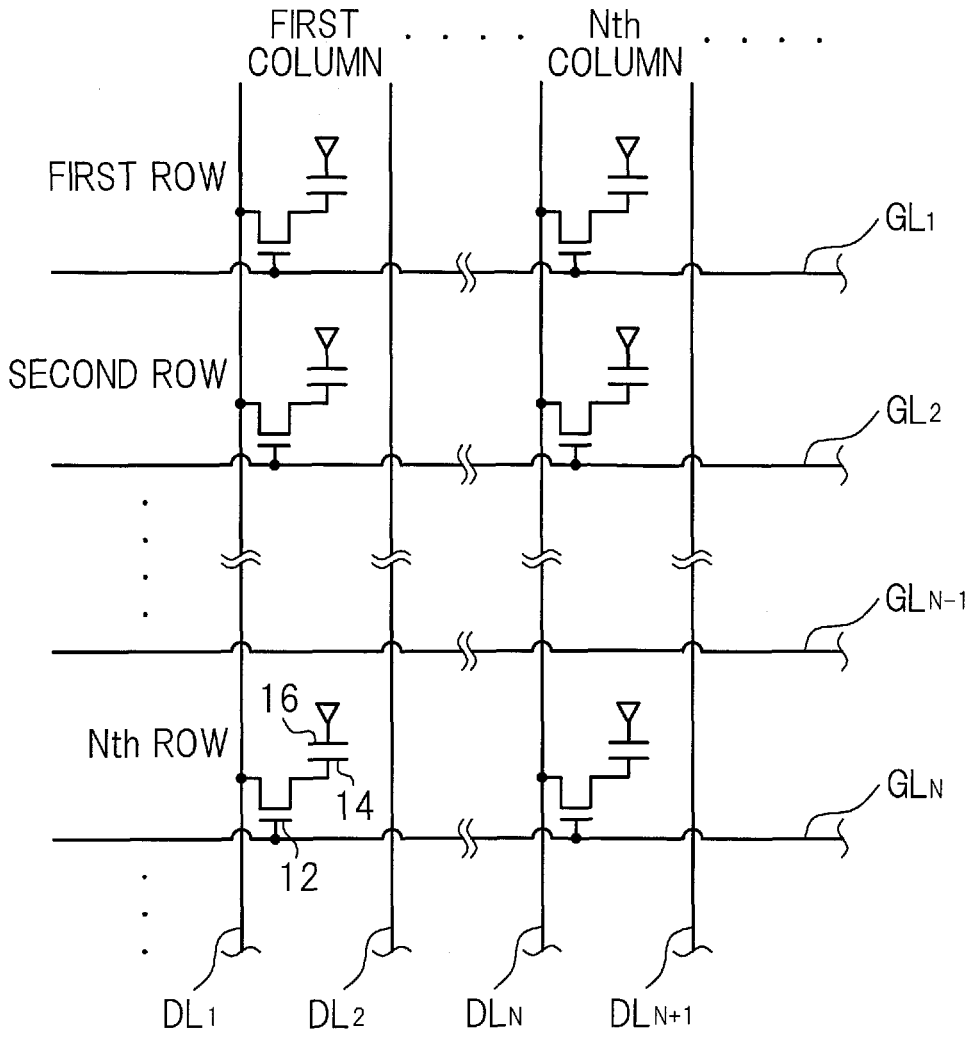
FIG. 2 is a diagram for explaining a liquid crystal panel.

FIG. 2 is a view for explaining a display region 10 of the first substrate of the liquid crystal panel.

On the first substrate of the liquid crystal panel, the plurality of data lines DL which extend in the vertical direction and the plurality of scanning lines GL which extend in the horizontal direction are arranged (see FIG. 2). Hereinafter, an Nth (N=1,2, . . . ) data line DL counted from a left side is described as a data line $DL_N$, and an Nth (N=1,2, . . . ) scanning line GL counted from the top is described as a scanning line $GL_N$.

Further, pixels are arranged on the first substrate in a matrix array. Each pixel includes a thin film transistor 12 (hereinafter referred to as TFT 12), a pixel electrode 14 connected to a source of the TFT 12, and a common electrode 16. In the case where a display mode of the liquid crystal display device 2 is a VA (Vertical Alignment) mode, for example, respective common electrodes 16 are arranged on the second substrate.

[Pixel]

Figure 3:
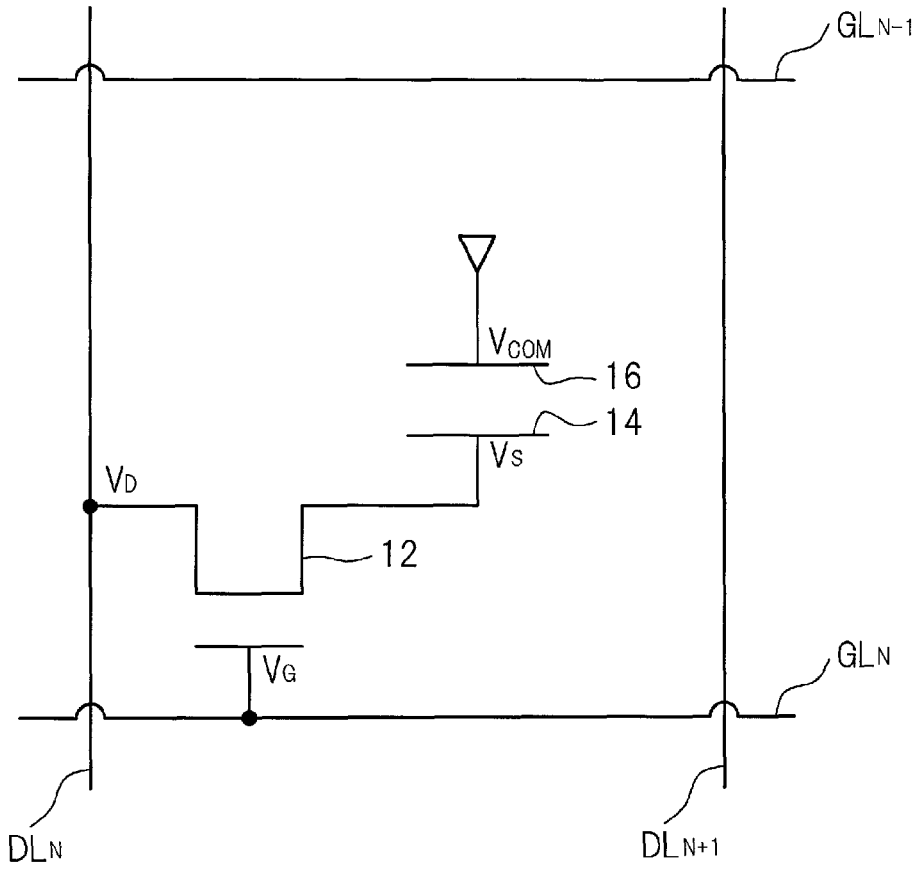
FIG. 3 is a diagram for explaining a pixel.

FIG. 3 is a view for explaining the pixel. That is, FIG. 3 shows the pixel which is positioned on an Nth column (see FIG. 2) and is also positioned at an Nth row (see FIG. 2). As shown in FIG. 3, the pixel is positioned at the Nth column and hence, a drain of the TFT 12 of this embodiment is connected to the Nth data line $DL_N$ counted from the left side. Further, the pixel is positioned at the Nth row and hence, a gate of the TFT 12 is connected to the Nth scanning line $GL_N$ counted from an upper side. Here, symbol $V_G$ indicates a potential of the gate of the TFT 12. Symbol $V_D$ indicates a potential of the drain of the TFT 12. Symbol $V_S$ indicates a potential of the source of the TFT 12. The Symbol $V_S$ also indicates a potential of the pixel electrode 14. Symbol $V_{COM}$ indicates a potential of the common electrode 16. In this embodiment, a potential higher than $V_{COM}$ becomes a voltage of positive polarity, and a potential lower than $V_{COM}$ becomes a voltage of negative polarity.

[Control Part]

The control part 4 is a control circuit such as a microcomputer, or a microprocessor, for example, and is provided for controlling the data line drive part 6 and the scanning line drive part 8. To be more specific, the control part 4 generates control signals for controlling the data line drive part 6 and the scanning line drive part 8 and outputs the control signals to the data line drive part 6 and the scanning line drive part 8. Image data for respective frames is inputted sequentially to the control part 4. The image data is data including gray level values of the respective pixels. The gray level values are numerical value data indicative of gray levels. In this embodiment, the gray level values are integer values ranging from 0 to 255. When the gray level value is 255, the gray level value indicates a maximum gray level. When the gray level value is 0, the gray level value indicates a minimum gray level. The specific manner of operation of the control part 4 is described later in detail.

[Scanning Line Drive Part and Data Line Drive Part]

The scanning line drive part 8 (output unit) outputs an ON voltage to the respective scanning lines GL for a predetermined time in accordance with a control signal. To be more specific, the scanning line drive part 8 outputs an ON voltage sequentially from the top (in order from the scanning line $GL_1$). As a result, in order from the upper pixel row, the ON voltage is outputted to the pixels included in the pixel row (to be more accurate, the gates of the TFTs 12 of the pixels included in the pixel row).

Figure 4:
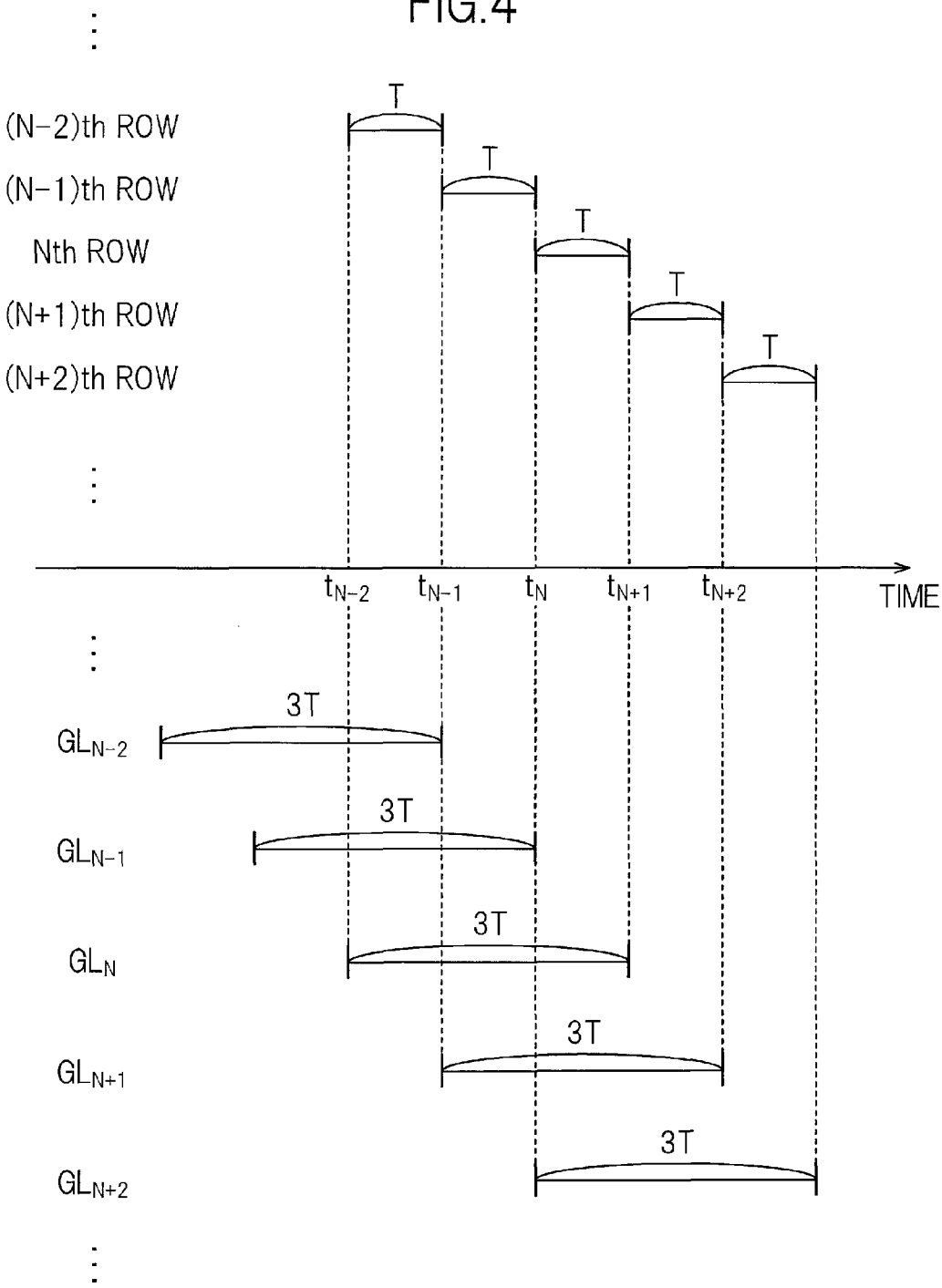
FIG. 4 is a view for explaining a manner of operation of a scanning line drive part and a manner of operation of a data line drive part.

FIG. 4 is a view for explaining the manner of operation of the scanning line drive part 8 and the manner of operation of the data line drive part 6. In FIG. 4, below an axis of abscissa which indicates the lapse of time, a period in which an ON voltage is outputted to the scanning line GL for every scanning line GL is indicated. Above the axis of abscissa, periods in which an image signal voltage is outputted to the respective pixels on the data line $DL_N$ from the (N−2)th data line $DL_N$ to the (N+2)th data line $DL_N$ are indicated. Particularly, a period in which an image signal voltage is outputted becomes short when a refresh rate is increased. Accordingly, when outputting of an ON voltage is started along with the start of a period in which an image signal voltage is outputted, it is difficult to ensure the stable supply of the ON voltage. In view of the above, by starting a period in which an ON voltage is outputted (hereinafter referred to as "ON voltage outputting period") before an image signal voltage outputting period, it is possible to ensure the stable supply of the ON voltage in the image signal voltage outputting period. Accordingly, in this embodiment, as shown in FIG. 4, an ON voltage is supplied to the respective scanning lines GL sequentially from the top for a period 3×T.

Since an ON voltage is outputted sequentially from the top as described above, the N-th ON voltage is outputted to the Nth scanning line $GL_N$ as counted from the top.

Figure 5:
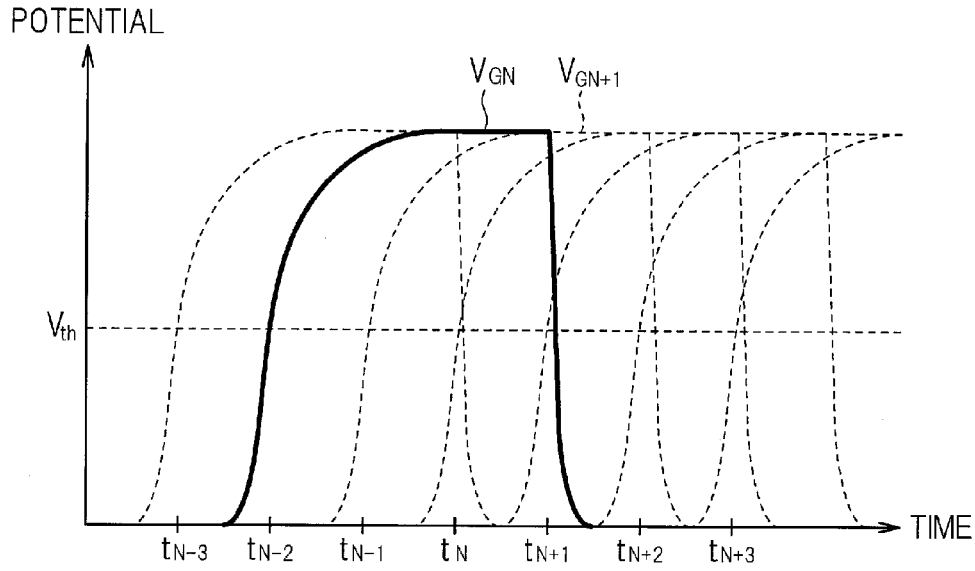
FIG. 5 is a graph showing a state where a gate voltage $V_{GN}$ is outputted to a plurality of scanning lines including a scanning line $GL_N$ from the scanning line drive part

FIG. 5 shows a state where a gate voltage $V_{GN}$ is outputted to the plurality of scanning lines including the scanning line $GL_N$ from the scanning line drive part 8. As shown in FIG. 5, a voltage applied to the scanning line $GL_N$ assumes a value equal to or more than a threshold voltage $V_{th}$ in a period from $t_{N-2}$ to $t_{N+1}$ so that an ON voltage for turning on the TFT 12 is outputted. The potential $V_S$ of the pixel electrode 14 at timing where the supply of the ON voltage to the scanning line $GL_N$ is finished (to be more specific, $t_{N+1}$) is held (written) even after completion of the ON voltage outputting period. In this specification, the potential $V_S$ of the pixel electrode 14 which becomes constant after the completion of the ON voltage outputting period is referred to as a written potential.

[Data Line Drive Part]

The data line drive part 6 repeatedly executes, in accordance with a control signal outputted from the control part 4, outputting of an image signal voltage to the respective data lines DL for every predetermined time T.

To be more specific, the data line drive part 6 outputs a voltage based on a gray level value of the pixel positioned on the Nth column (to be more accurate, the pixel where the drain of the TFT 12 is connected to the data line $DL_N$) to the data line $DL_N$ (image signal line) as an image signal voltage of the pixel. Here, the data line drive part 6 outputs an image signal voltage of the pixel positioned on the Nth row to the data line $DL_N$ in the Nth order. To focus on one data line $DL_N$, eventually, the data line drive part 6 (image signal outputting unit) sequentially outputs the image signal voltages corresponding to the respective pixels to the respective pixels positioned on the Nth column.

Hereinafter, a period having a length T in which the data line drive part 6 outputs an image signal voltage one time is referred to as an image signal voltage outputting period.

Outputting of an image signal voltage is performed at timing that the scanning line drive part 8 outputs an ON voltage to the respective scanning lines GL. That is, when the scanning line drive part 8 outputs an ON voltage to the scanning line $GL_N$, an image signal voltage is outputted to the pixel positioned on the Nth row (to be more accurate, the pixel in which the gate of the TFT 12 is connected to the scanning line $GL_N$). That is, when an image signal voltage of the pixel positioned on the Nth row is outputted, an ON voltage is outputted to the scanning line $GL_N$. In a portion of FIG. 4 above the time axis, for every row, a period in which an image signal voltage of the pixel positioned on the row is outputted is indicated. Here, $t_N$ indicates timing at which outputting of an image signal voltage of the pixel positioned on the Nth row is started, and $t_{N+1}$ indicates timing at which outputting of an image signal voltage of the pixel positioned on the Nth row is finished. As described previously, in the period in which an image signal voltage is outputted to the pixel on the Nth row, an ON voltage is being outputted to the scanning line $GL_N$.

Further, also as can be understood from FIG. 4, outputting of an ON voltage to the scanning line $GL_N$ is started simultaneously with outputting of an image signal voltage to the pixel positioned on the (N−2)th row and hence, outputting of an ON voltage to the scanning line $GL_N$ is performed also when outputting of an image signal voltage to the pixel positioned on the row before the Nth row is performed (see FIG. 4).

[Refresh Rate]

When a refresh rate is high (for example, 240 Hz), as described previously, by inputting an ON voltage to the scanning line before the timing at which an image signal voltage is inputted to each pixel, the stable supply of the ON voltage is ensured. However, when the refresh rate is high, a length of an image signal voltage outputting period per se becomes short and hence, there arises a drawback that the image signal voltage outputting period is finished before the potential $V_S$ of the pixel electrode assumes a potential corresponding to a gray level value so that writing deficiency occurs thus deteriorating image quality.

Accordingly, to allow the potential $V_S$ of the pixel electrode to assume a target potential and to become stable as early as possible, the liquid crystal display device 2 of this embodiment adopts the following constitutions in addition to starting of the ON voltage outputting period before the image signal outputting period.

That is, in the liquid crystal display device 2, instead of outputting a gray level signal voltage having a voltage corresponding to a gray level value as an image signal voltage over the whole image signal voltage outputting period, the data line drive part 6 firstly outputs a correction gray level signal voltage different from the gray level signal voltage for increasing a speed at which the potential $V_S$ of the pixel electrode changes as an image signal voltage and, thereafter, outputs the gray level signal voltage as an image signal voltage.

Figure 6:
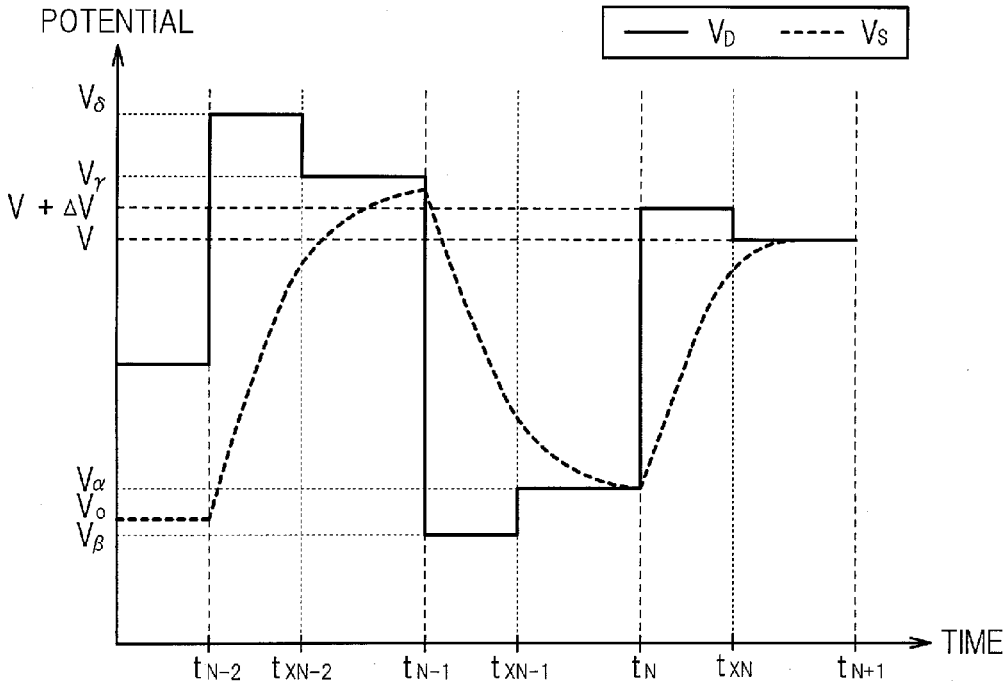
FIG. 6 is a view showing the transition of an image signal voltage and a potential of a pixel electrode in an ON-voltage outputting period.

FIG. 6 is a view for explaining the above-mentioned constitution, and shows the transition of an image signal voltage and a potential of the pixel electrode 14 in an ON voltage outputting period. Here, the explanation is made by focusing on the pixel which is positioned on the Nth row and is positioned on the Nth column (hereinafter referred to as target pixel). $V_S$ indicates a potential of the pixel electrode of the target pixel. $V_D$ indicates an image signal voltage inputted to the drain of the TFT12 of the target pixel.

A period from $t_N$ to $t_{N+1}$ indicates an image signal voltage outputting period in which an image signal voltage of the target pixel positioned on the Nth row is outputted. Here, a period from $t_N$ to $t_{XN}$ indicates a period (second period) in which the above-mentioned correction gray level signal voltage is outputted to the data line $DL_N$ as the image signal voltage of the target pixel, and a period from $t_{XN}$ to $t_{N+1}$ indicates a period (first period) in which the above-mentioned gray level signal voltage is outputted to the data line $DL_N$ as the image signal voltage of the target pixel.

Further, out of a period in which an ON voltage is outputted to the scanning line $GL_N$, a period ranging from $t_{N-2}$ to $t_N$ is constituted of an image signal voltage outputting period in which an image signal voltage of a pixel two pixel above the target pixel is outputted and an image signal voltage outputting period in which an image signal voltage of a pixel one pixel above the target pixel is outputted. Also the first period and the second period are allocated to two image signal voltage outputting periods ranging from $t_{N-2}$ to $t_N$ respectively. That is, outputting of the image signal voltages of the pixels positioned on the (N−2)th row and on the (N−1)th row is performed in the period from $t_{N-2}$ to $t_N$ and hence, a potential of the pixel electrode 14 of the target pixel positioned on the Nth row is changed.

Eventually, a value V+ΔV of $V_D$ in the period from $t_N$ to $t_{XN}$ indicates a potential of the above-mentioned correction gray level signal voltage, and a value V of $V_D$ in the period from $t_{XN}$ to $t_{N+1}$ indicates a potential of the above-mentioned gray level signal voltage. Further, ΔV indicates a potential difference between the gray level signal voltage and the correction gray level signal voltage. Further, a value $V_\alpha$ of $V_D$ in the first period in which an image signal voltage is inputted to a one-pixel preceding pixel in order indicates a gray level signal voltage of a one-pixel upper pixel. In the same manner, a value $V_\beta$ of $V_D$ in the second period in which an image signal voltage is inputted to the one-pixel preceding pixel in order indicates a correction gray level signal voltage of the one-pixel upper pixel. Further, a value $V_\gamma$ of $V_D$ in the first period in which an image signal voltage is inputted to a two-pixel preceding pixel in order indicates a gray level signal voltage of a two-pixel upper pixel. In the same manner, a value $V_\delta$ of $V_D$ in the second period in which an image signal voltage is inputted to the two-pixel preceding pixel in order indicates a correction gray level signal voltage of the two-pixel upper pixel.

$V_0$ indicates a value of $V_S$ at a point of time $t_{N-2}$ at which the ON voltage outputting period starts. $V_0$ may be a potential of the common electrode 16.

As shown in FIG. 6, in the liquid crystal display device 2, in the period from $t_N$ to $t_{XN}$, a correction gray level signal voltage which differs from a gray level signal voltage is outputted. A potential of the pixel electrode of the target pixel is changed up to $t_N$ by being influenced by an image signal voltage of one-or-more-pixel preceding pixel before the target pixel in order. However, in this embodiment, the correction gray level signal voltage V+ΔV is set based on not only a gray level value of the target pixel but also gray level values of a plurality of pixels constituted of the one-or-more-pixel preceding pixels before the target pixel in order and hence, the potential $V_S$ easily assumes the target potential V and becomes stable until $t_{N+1}$ at which the image signal voltage outputting period is finished. Due to such an operation, even in the case of a high refresh rate, the potential $V_S$ of the pixel electrode is controlled such that the potential $V_S$ of the pixel electrode becomes stable at a potential corresponding to the gray level value which the potential $V_S$ of the pixel electrode aims at until the image signal outputting period is finished.

Hereinafter, the manner of operation of the control part 4 for making the potential $V_S$ of the pixel electrode stable until the image signal voltage outputting period is finished is explained specifically.

[Detail of Control Part]

Figure 7:
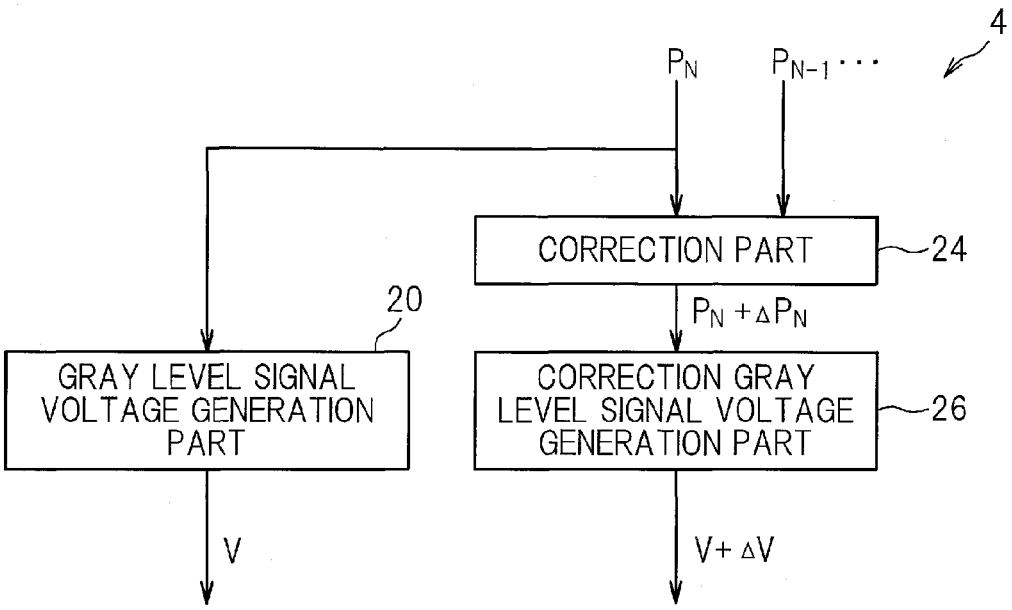
FIG. 7 is a block diagram showing the specific constitution of a control part.

FIG. 7 shows the specific constitution of the control part 4 (control unit). As shown in the drawing, the control part 4 includes a gray level signal voltage generation part 20, a correction part 24 and a correction gray level signal voltage generation part 26.

In this embodiment, in the liquid crystal display device 2, the respective pixels are selected in accordance with the sequence corresponding to a scanning method. Each time the pixel is selected, the gray level signal voltage generation part 20, the correction part 24 and the correction gray level signal voltage generation part 26 are operated as explained hereinafter. The explanation is made hereinafter with respect to a case where the target pixel (pixel which is positioned on the Nth row and is positioned on the Nth column) is selected and a gray level value of the target pixel is expressed as "$P_N$". Further, a gray level value of the pixel which is positioned on the (N−1)th row and is positioned on the Nth column is expressed as "$P_{N-1}$", and a gray level value of the pixel which is positioned on the (N−2)th row and is positioned on the Nth column is expressed as "$P_{N-2}$".

[Gray Level Signal Voltage Generation Part]

The gray level signal voltage generation part 20 generates, based on the gray level value $P_N$ of the target pixel, a gray level signal voltage V corresponding to the gray level value $P_N$. To be more specific, the gray level signal voltage generation part 20 generates the gray level signal voltage V through the DA conversion.

In this embodiment, the gray level signal voltage V which corresponds to a gray level value "0" is set to the potential $V_{COM}$ of the common electrode 16.

The gray level signal voltage generation part 20 outputs the gray level signal voltage V to the data line drive part 6. The data line drive part 6 outputs the gray level signal voltage V as an image signal voltage of the target pixel in accordance with a control signal in the first period.

[Correction Part]

The correction part 24 acquires a correction gray level value $P_N+\Delta P_N$ which becomes a basis for generating a correction gray level signal voltage $V+\Delta V$ based on a gray level value $P_N$ of the target pixel and a gray level value or gray level values ($P_{N-1}$ . . . ) of one or plurality of preceding pixels which come before the target pixel in order. In this embodiment, firstly, the correction part 24 receives, together with the gray level value $P_N$ of the target pixel, the gray level value $P_{N-1}$ of one-pixel preceding pixel before the target pixel in order and the gray level value $P_{N-2}$ of two-pixel preceding pixel before the target pixel in order which are stored in a line memory additionally as inputs. Next, the correction part 24 reads out a lookup table (hereinafter referred to as LUT) in which the gray level value $P_{N-2}$, the gray level value $P_{N-1}$ and a control amount are associated with each other from a storage unit, and acquires the control amount associated with the inputted gray level value $P_{N-1}$ and gray level value $P_{N-2}$. Then, the correction part 24 reads out a lookup table in which the control amount, the gray level value $P_N$ and a correction amount $\Delta P_N$ are associated with each other from a storage unit and acquires the correction amount $\Delta P_N$, and acquires a correction gray level value $P_N+\Delta P_N$ by adding the gray level value $P_N$ of the target pixel to the acquired correction amount $\Delta P_N$. Here, the correction amount $\Delta P_N$ corresponds to a gray level value obtained by converting the potential difference between a gray level signal voltage and a correction gray level signal voltage into a gray level value.

Figure 8A:
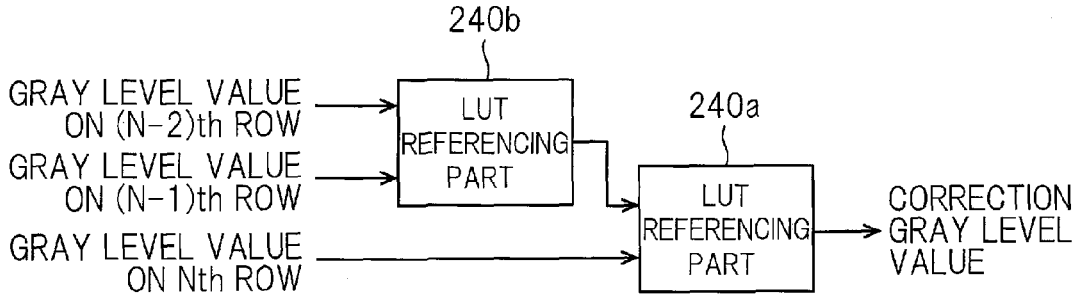
FIG. 8A is a block diagram showing the constitution of a correction part of the first embodiment.

FIG. 8A shows the constitution of the correction part 24 according to this embodiment. As shown in the drawing, the correction part 24 includes an LUT referencing part 240*a* and an LUT referencing part 240*b*, and acquires the correction gray level value $P_N+\Delta P_N$ by receiving the gray level values $P_N$ to $P_{N-2}$ as inputs in the manner as described previously. Modifications of the correction part 24 are explained later.

[Correction Gray Level Signal Voltage Generation Part]

Then, the correction gray level signal voltage generation part 26, based on the correction gray level value $P_N+\Delta P_N$, generates the correction gray level signal voltage $V+\Delta V$ corresponding to the correction gray level value $P_N+\Delta P_N$. To be more specific, the correction gray level signal voltage generation part 26 generates the correction gray level signal voltage $V+\Delta V$ through the DA conversion. Accordingly, the correction gray level signal voltage $V+\Delta V$ which is outputted as an image signal voltage in the second period is generated based on the gray level value $P_N$ of the target pixel and the gray level values of one-or-more-pixel preceding pixels before the target pixel in order.

After generating the correction gray level signal voltage $V+\Delta V$, the correction gray level signal voltage generation part 26 outputs the correction gray level signal voltage $V+\Delta V$ to the data line drive part 6. The data line drive part 6 outputs, in response to a control signal, the correction gray level signal voltage $V+\Delta V$ as an image signal voltage of the target pixel in the second period.

As described above, the correction gray level signal voltage is set based on the gray level value of the target pixel and the gray level values of one-or-more-pixel preceding pixels before the target pixel in order. When a higher refresh rate is adopted, to ensure a stable supply of an ON voltage, it is preferable to input an ON voltage in an image signal voltage outputting period of two-or-more-pixel preceding pixels before the target pixel instead of one-pixel preceding pixel before the target pixel. This is because, as indicated by the period $t_N$ to $t_{N+1}$ shown in FIG. 5, it is desirable that an ON voltage is also constant and stable in the image signal voltage outputting period. As shown in FIG. 6, when an ON voltage is inputted in the image signal voltage outputting period of two-or-more-pixel preceding pixels before the target pixel, before the image signal voltage outputting period ($t_N$ to $t_{N-1}$) of the target pixel is started, the potential of the drain $V_D$ is changed ($V_\alpha$ to $V_\delta$) so that the potential $V_S$ of the pixel electrode is changed. In such a case, by generating the correction gray level signal voltage $V+\Delta V$ in the second period ($t_N$ to $t_{XN}$) based on gray level values of a plurality of pixels including the one-pixel preceding pixel and the two-pixel preceding pixel before the target pixel, it is possible to allow the potential $V_S$ of the pixel electrode to assume the target potential V and to become stable as early as possible. Accordingly, the deterioration of image quality attributed to writing deficiency at the time of high refresh rate can be suppressed.

Modification 1 of First Embodiment

Figure 8B:
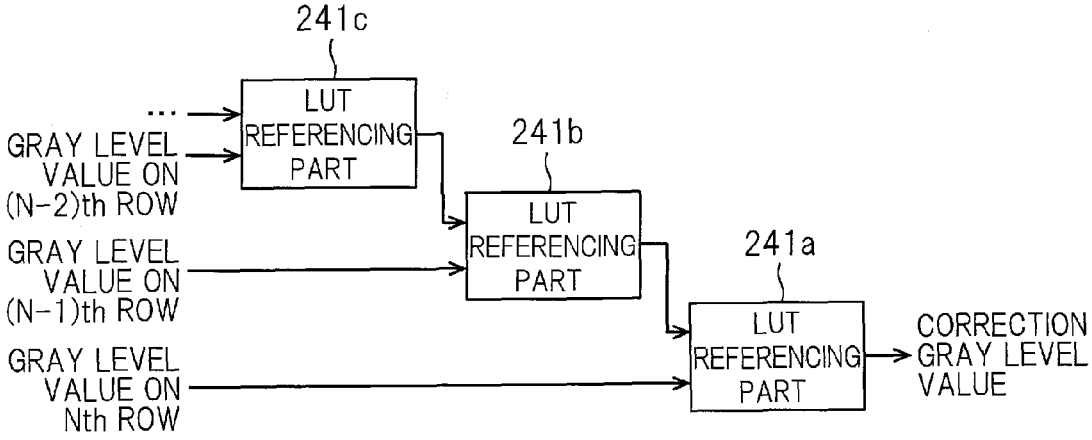
FIG. 8B is a block diagram showing the constitution of a correction part of a modification 1 of the first embodiment.

Here, the modification 1 of this embodiment is explained. FIG. 8B conceptually shows the constitution of the correction part 24 of the modification 1 of this embodiment. Except for the constitution of the correction part 24 and a length of an ON voltage outputting period, the constitution of the liquid crystal display device of the modification 1 is substantially equal to the constitution of the liquid crystal display device of the above-mentioned embodiment and hence, the explanation of the constitution other than the constitution of the correction part 24 is omitted. As shown in FIG. 8B, in the correction part 24, LUT referencing parts 241*a* to 241*c* are arranged in multiple stages corresponding to the increase of the number of inputting gray level values. In the above-mentioned first embodiment, the correction part 24 acquires the correction gray level value $P_N+\Delta P_N$ by receiving, besides the gray level value $P_N$ of the target pixel, the gray level value $P_{N-1}$ of one-pixel preceding pixel before the target pixel in order and the gray level value $P_{N-2}$ of two-pixel preceding pixel before the target pixel in order which are stored in a line memory. In this modification 1, the correction part 24 acquires the correction gray level value $P_N+\Delta P_N$ by further acquiring a gray level value of the more-pixel preceding pixel before the target pixel in order as inputs. When the ON voltage outputting period becomes 4 times, 5 times or more as long as the image signal voltage outputting period, by increasing the number of inputting gray level values of the preceding pixels before the target pixel in order such as 3 or 4, the accuracy of a correction gray level signal voltage is enhanced whereby the potential $V_S$ of the pixel electrode can be surely adjusted to a target potential.

Modification 2 of First Embodiment

Figure 8C:
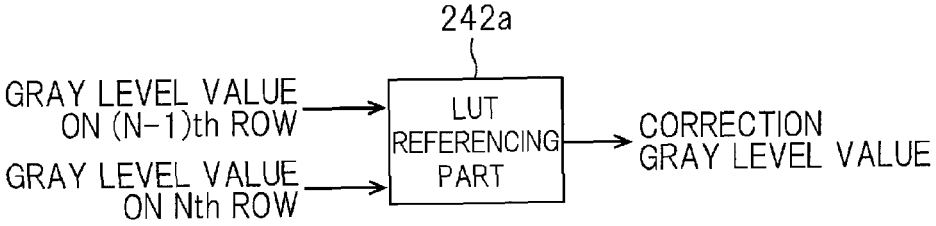
FIG. 8C is a block diagram showing the constitution of a correction part of a modification 2 of the first embodiment.

Next, the modification 2 of this embodiment is explained. FIG. 8C conceptually shows the constitution of the correction part 24 of the modification 2 of this embodiment. Except for the constitution of the correction part 24, the constitution of the liquid crystal display device of the modification 2 is substantially equal to the constitution of the liquid crystal display device of the above-mentioned embodiment and hence, the explanation of the constitution other than the constitution of the correction part 24 is omitted. As shown in FIG. 8C, the correction part 24 acquires the correction gray level value $P_N+\Delta P_N$ by receiving the gray level value $P_N$ of the target pixel and the gray level value $P_{N-1}$ of one-pixel preceding pixel before the target pixel in order which is stored in a line memory as inputs and by referencing an LUT by an LUT referencing part 242*a*. In this manner, the correction gray level signal voltage may be set based on the gray level value $P_N$ of the target pixel and the gray level value $P_{N-1}$ of one-pixel preceding pixel before the target pixel in order.

Figure 9A:
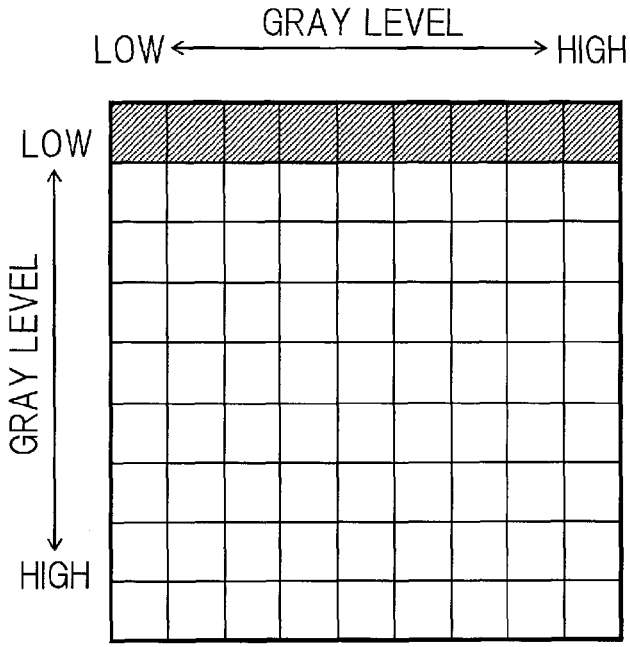
FIG. 9A is a view schematically showing an LUT of the modification 2 of the first embodiment.

FIG. 9A is a view which conceptually shows the LUT which is referenced by the LUT referencing part 242*a* in the modification 2. The LUT shown in the drawing is expressed as an LUT of 8-bits gray levels, wherein 256 gray levels are divided by 8 gray levels. In this case, to assume that the respective gray levels are arranged at equal intervals, the gray levels to be selected become 9 gray levels consisting of a 0th gray level, a 32nd gray level, a 64th gray level, a 96th gray level, a 128th gray level, a 160th gray level, a 192nd gray level, a 224th gray level, and a 255th gray level. Accordingly, the LUT becomes a table having a size of 9×9. By referencing the LUT, it is possible to acquire a correction amount $\Delta P_N$ which is associated with conditions of two gray level values $P_N$ and $P_{N-1}$. In acquiring the correction amount $\Delta P_N$, a value of the correction amount $\Delta P_N$ may be acquired using linear interpolation.

Figure 9B:
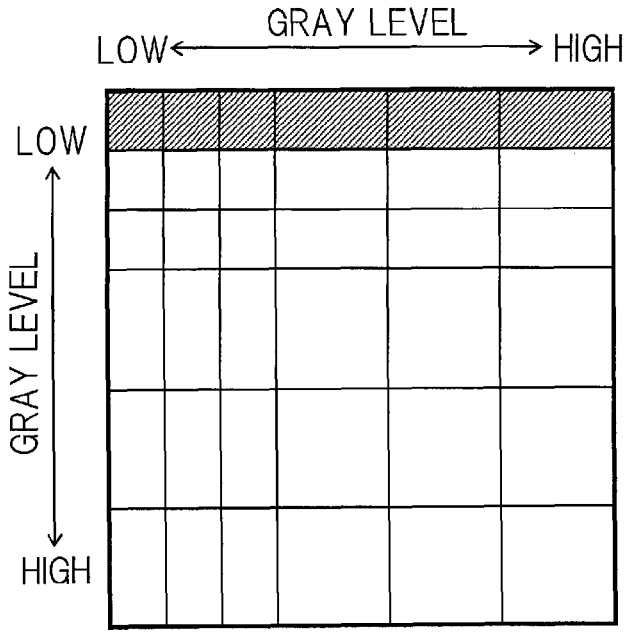
FIG. 9B is a view schematically showing the LUT of the modification 2 of the first embodiment.

Further, as shown in FIG. 9B, with respect to the gray level value $P_N$ or the gray level value $P_{N-1}$, it may be possible to reference an LUT where the correction amount $\Delta P_N$ is set more finely at low gray levels than at high gray levels. In such a case, for example, it may be possible to use an LUT where the gray scale values are divided such that a gray level interval of the gray level value $P_N$ on a low gray level side and a gray level interval of the gray level value $P_N$ on a high gray level side differ from each other. By adopting such an LUT, in this modification, the LUT becomes a table having a size of 9×9 to a table having a size of 6×6 so that a size of the table can be decreased. Accordingly, when the gray level value $P_N$ becomes a low gray level, it is possible to enhance the accuracy of a correction gray level signal voltage so that the potential $V_S$ of the pixel electrode can be surely adjusted to a target potential. The LUT shown in FIG. 9B may be used in other modifications of this embodiment.

Modification 3 of First Embodiment

Figure 10:
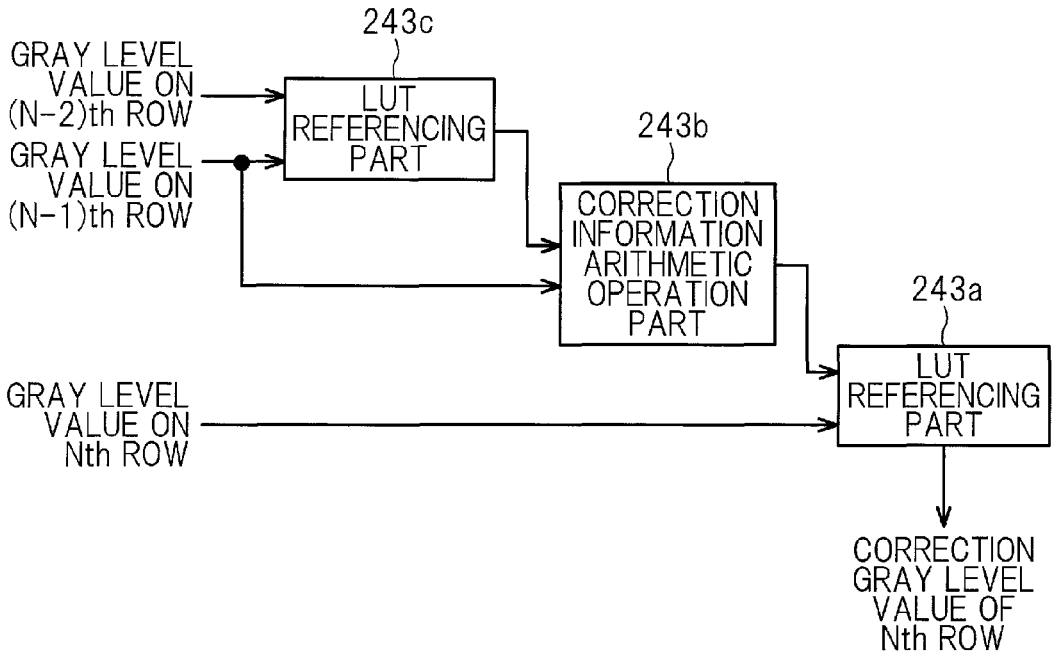
FIG. 10 is a block diagram showing the constitution of a correction part of a modification 3 of the first embodiment.

Next, the modification 3 of this embodiment is explained. FIG. 10 shows the constitution of the correction part 24 of the modification 3 of this embodiment. Except for the constitution of the correction part 24, the constitution of the liquid crystal display device of the modification 3 is substantially equal to the constitution of the liquid crystal display device of the above-mentioned embodiment and hence, the explanation of the constitution other than the constitution of the correction part 24 is omitted. As shown in FIG. 10, the correction part 24 acquires the correction gray level value $P_N+\Delta P_N$ by receiving the gray level value $P_N$ of the target pixel and the gray level value $P_{N-1}$ of one-pixel preceding pixel before the target pixel in order and the gray level value $P_{N-2}$ of two-pixel preceding pixel before the target pixel in order which are stored in a line memory as inputs.

To be more specific, an LUT referencing part 243*c* reads out an LUT in which the gray level value $P_{N-1}$, the gray level value $P_{N-2}$ and a correction amount $\Delta'P_{N-1}$ are associated with each other from a storage unit, and acquires the correction amount $\Delta'P_{N-1}$ corresponding to two inputted values. Next, a correction information arithmetic operation part 243*b* receives the correction amount $\Delta'P_{N-1}$ and the gray level value $P_{N-1}$ as inputs and acquires a correction gray level value $P_{N-1}+\Delta'P_{N-1}$ by summing up these values. Finally, an LUT referencing part 243*a* reads out an LUT in which the correction gray level value $P_{N-1}+\Delta'P_{N-1}$ acquired by the correction information arithmetic operation part 243*b* and the gray level value $P_N$ are associated with each other from a storage unit, and acquires the correction gray level value $P_N+\Delta P_N$ corresponding to two inputted values. By performing such operations, a data amount of correction amount acquired by the LUT referencing part 243*c* can be set smaller than a data amount of the correction gray level value acquired by the LUT referencing part 243*a* so that a circuit size of the correction part 24 can be made small.

Figure 11:
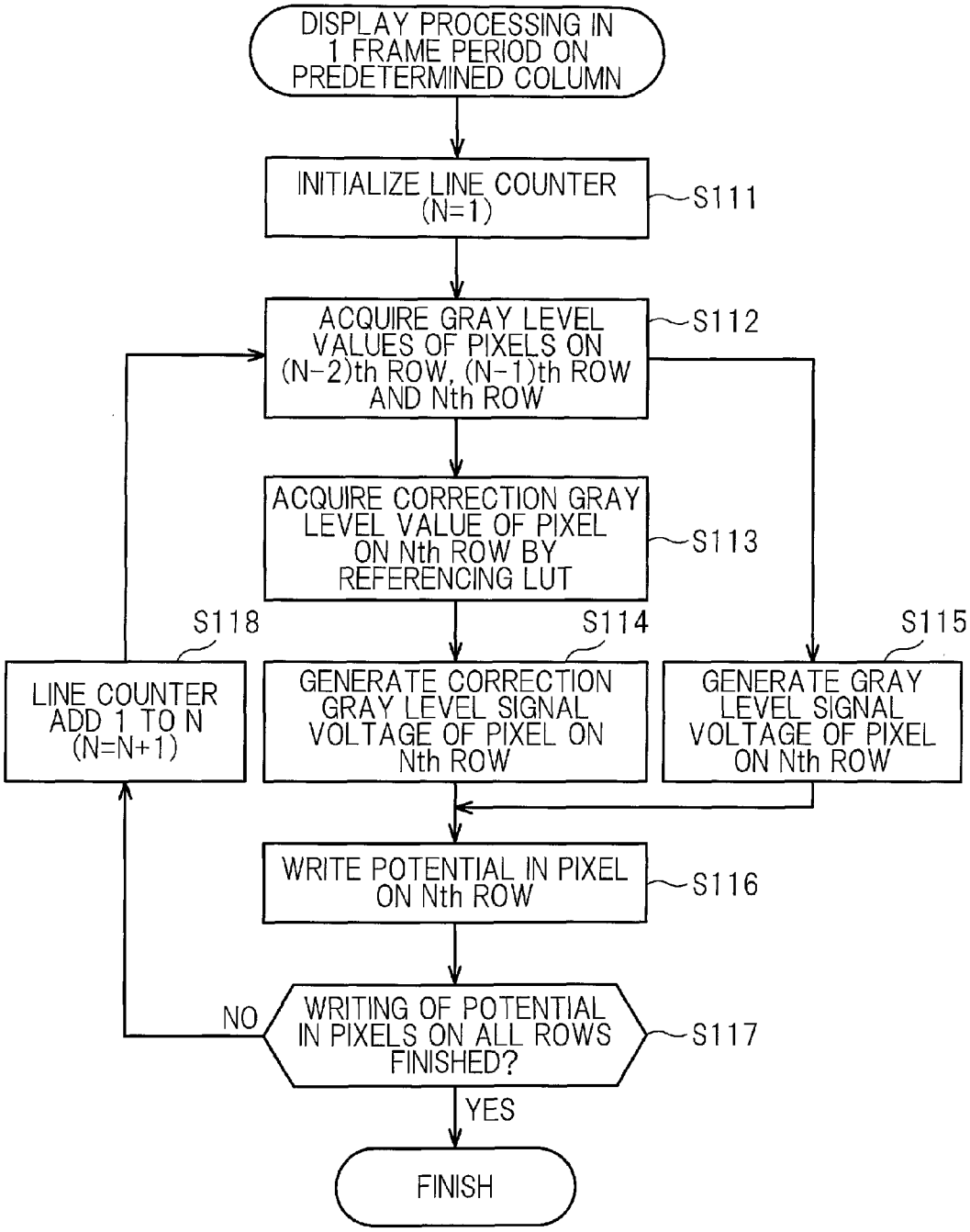
FIG. 11 is a control flowchart of display processing in a 1 frame period in the modification 3 of the first embodiment.

FIG. 11 is a control flowchart of display processing in 1 frame period in the case of the modification 3. In the drawing, for the sake of brevity, the explanation is made by focusing on display processing of the Nth column (predetermined column) where the target pixel exists.

When the display processing is started, firstly, a line counter is initialized (S111). Next, the correction part 24 acquires gray level values of the pixels on the (N−2)th row to the Nth row (S112). Here, the initial setting may be made such that when N is set to 1 (N=1), the correction part 24 acquires 0 as the gray level values of the pixels on the (N−2)th row and the (N−1)th row. Thereafter, the correction part 24 acquires the correction gray level value $P_N+\Delta P_N$ by referencing the LUT (S113). Further, the correction gray level signal voltage generation part 26 generates the correction gray level signal voltage V+ΔV (S114). On the other hand, the gray level signal voltage generation part 20 generates the gray level signal voltage V based on the inputted gray level value $P_N$ (S115). Due to such operations, the correction gray level signal voltage is outputted in the second period of the image signal voltage outputting period, and the gray level signal voltage is outputted in the first period of the image signal voltage outputting period so that the potential is written in the pixels on the Nth row (S116).

After S116, the correction part 24 determines whether or not the writing of the potential in the pixels on all rows is finished (S117). When the writing of the potential in the pixels on all rows is not finished, the line counter adds 1 to N (S118), and the correction part 24 repeats the processing in steps S112 to S116 again. When the writing of the potential in the pixels on all rows is finished, the display processing in 1 frame period is finished.

In the modification 3, although the correction part 24 acquires the correction gray level value $P_N+\Delta P_N$ by receiving the inputs of the gray level values $P_N$ to $P_{N-2}$ using the LUT referencing parts 243*a*, 243*c*, the correction part 24 may acquire the correction gray level value $P_N+\Delta P_N$ by referencing a three-dimensional LUT.

Modification 4 of First Embodiment

Figure 12:
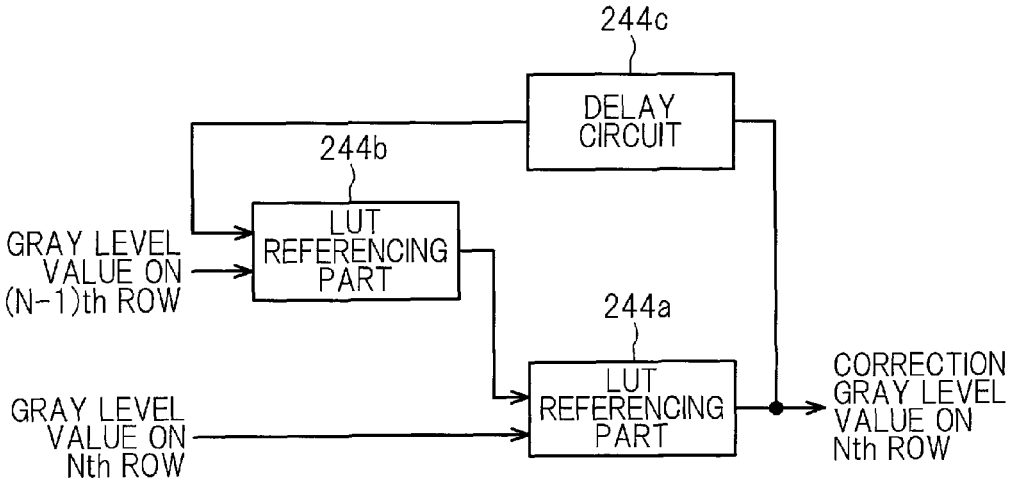
FIG. 12 is a view showing the constitution of a correction part of a modification 4 of the first embodiment.

Next, the modification 4 of this embodiment is explained. FIG. 12 conceptually shows the constitution of the correction part 24 of the modification 4 of this embodiment. Except for the constitution of the correction part 24, the constitution of the liquid crystal display device of the modification 4 is substantially equal to the constitution of the liquid crystal display device of the above-mentioned embodiment and hence, the explanation of the constitution other than the constitution of the correction part 24 is omitted. The correction part 24 of the modification 4 acquires, as the input for acquiring the correction gray level value $P_N+\Delta P_N$ of the pixel on the Nth row, the correction gray level value $P_{N-1}+\Delta P_{N-1}$ of the pixel on the (N−1)th row through a delay circuit 244*c*.

To be more specific, firstly, an LUT referencing part 244*b* acquires, by referencing an LUT in which the gray level value $P_{N-1}$, the correction gray level value $P_{N-1}+\Delta P_{N-1}$ and correction information are associated with each other, a control amount based on two inputted values. Then, an LUT referencing part 244*a* acquires, by referencing an LUT in which the control amount, the gray level value $P_N$ and the correction gray level value $P_N+\Delta P_N$ are associated with each other, the correction gray level value $P_N+\Delta P_N$. Due to such operations, it is possible to acquire the correction gray level signal voltage $V+\Delta V$ based on the gray level value $P_{N-1}$ and the correction gray level value $P_{N-1}+\Delta P_{N-1}$ of one-pixel preceding pixel. In this case, the correction gray level value $P_{N-1}+\Delta P_{N-1}$ is generated based on at least the gray level value $P_{N-1}$ and the gray level value $P_{N-2}$ and hence, eventually, it is safe to say that the correction gray level value $P_N+\Delta P_N$ is generated based on the gray level values of a plurality of pixels including one-or-more-pixel preceding pixels in order.

Figure 13:
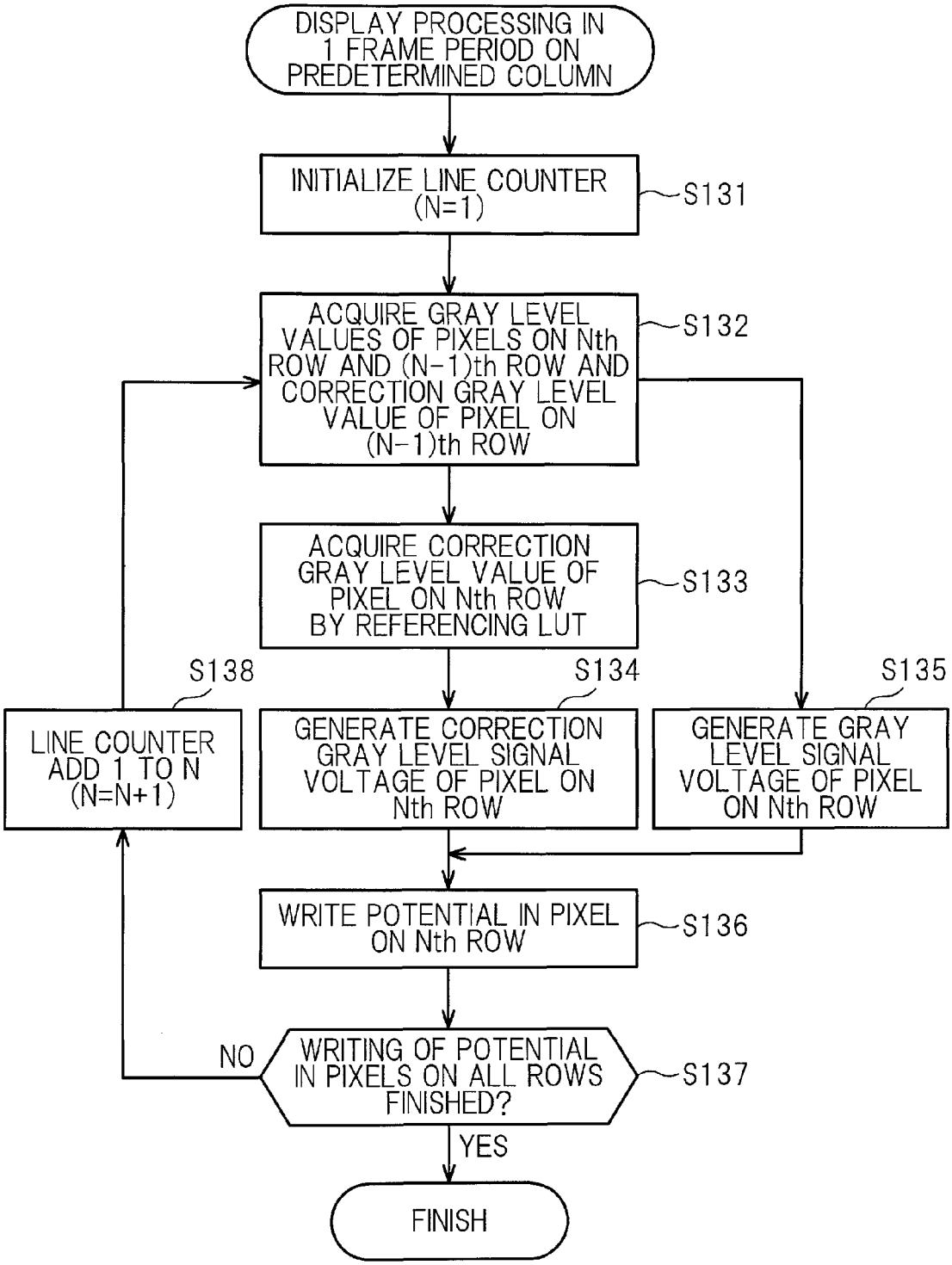
FIG. 13 is a control flowchart of display processing in a 1 frame period in the modification 4 of the first embodiment.

FIG. 13 is a control flowchart for explaining display processing in 1 frame period in the case of the modification 4.

When the display processing is started, firstly, the line counter is initialized (S131). Next, the correction part 24 acquires gray level values of the pixels on the (N−1)th row to the Nth row and the correction gray level value of the pixel on the (N−1)th row (S132). Here, when N is set to 1 (N=1), the correction part 24 may acquire 0 as the gray level value and the correction gray level value of the pixel on the (N−1)th row in initial setting. Thereafter, the correction part 24 acquires the correction gray level value $P_N+\Delta P_N$ by referencing the LUT (S133). Further, the correction gray level signal voltage generation part 26 generates the correction gray level signal voltage $V+\Delta V$ (S134). On the other hand, the gray level signal voltage generation part 20 generates the gray level signal voltage V based on the inputted gray level value $P_N$ (S135). Due to such operations, the correction gray level signal voltage is outputted in the second period of the image signal voltage outputting period, and the gray level signal voltage is outputted in the first period of the image signal voltage outputting period so that the potential is written in the pixel on the Nth row (S136).

After step S136, the correction part 24 determines whether or not the writing of the potential in the pixels on all rows is finished (S137). When the writing of the potential in the pixels on all rows is not finished, the line counter adds 1 to N (S138), and the correction part 24 repeats the processing in steps S132 to S136 again. When the writing of the potential in the pixels on all rows is finished, the display processing in 1 frame period is finished.

Second Embodiment

Figure 14:
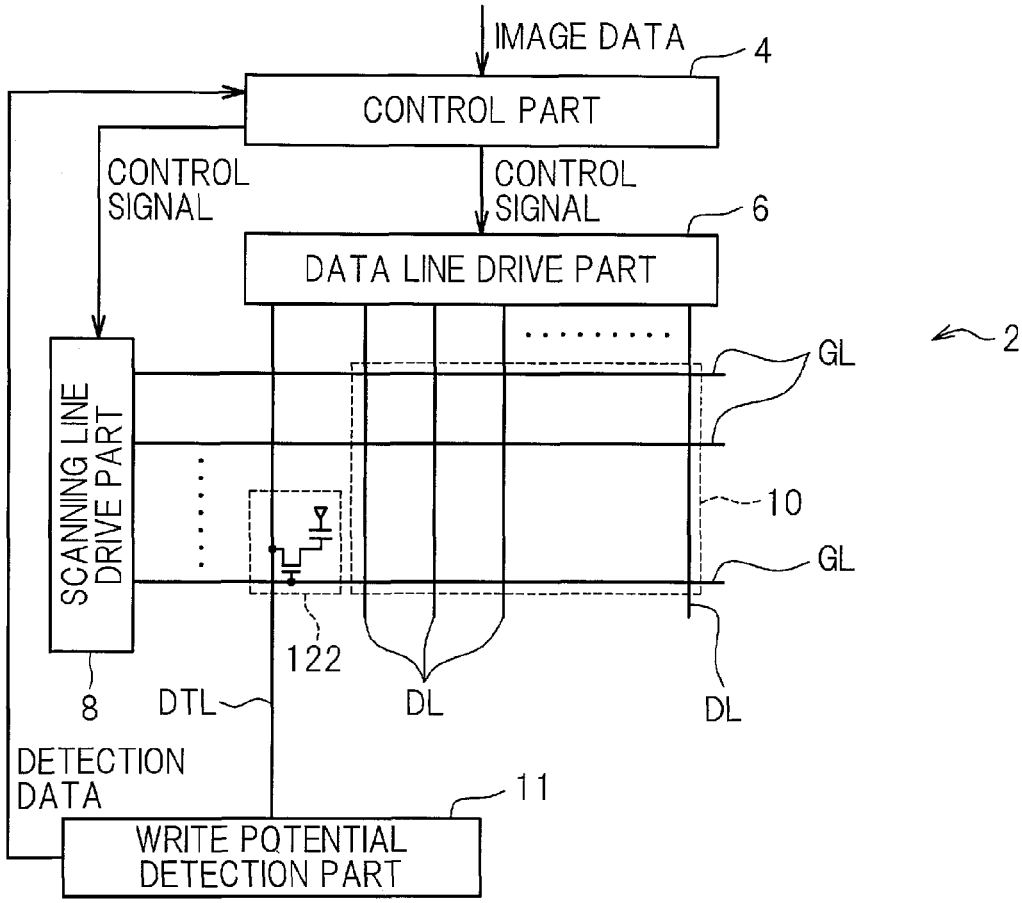
FIG. 14 is a constitutional view of a liquid crystal display device according to a second embodiment of the present invention.

Next, a liquid crystal display device according to the second embodiment of the present invention is explained. FIG. 14 is a constitutional view of the liquid crystal display device according to the second embodiment. As shown in the drawing, except for that the liquid crystal display device of the second embodiment includes a write potential detection part 11 (detection circuit), the constitution of the liquid crystal display device of the second embodiment is substantially equal to the constitution of the liquid crystal display device of the first embodiment. Accordingly, the explanation of parts substantially equal to the corresponding parts of the first embodiment is omitted when appropriate.

As shown in FIG. 14, the write potential detection part 11 is connected to a detection line DTL, and the detection line DTL is connected to a group of detection pixels arranged outside the display area 10 in which an image is displayed. The write potential detection part 11 detects a writing state of pixels based on states of detection pixels 122 and transmits detection data to the control part 4 (correction part 24). Although the detection pixel is provided to respective rows and image signal voltages corresponding to the image signal voltages of the column of the target pixel are inputted to the detection pixels in the second embodiment, the detection pixel may be provided to some rows and the number of detection pixels may be suitably set. Further, the detection pixel may be provided to respective columns and may be provided to some columns.

Figure 15:
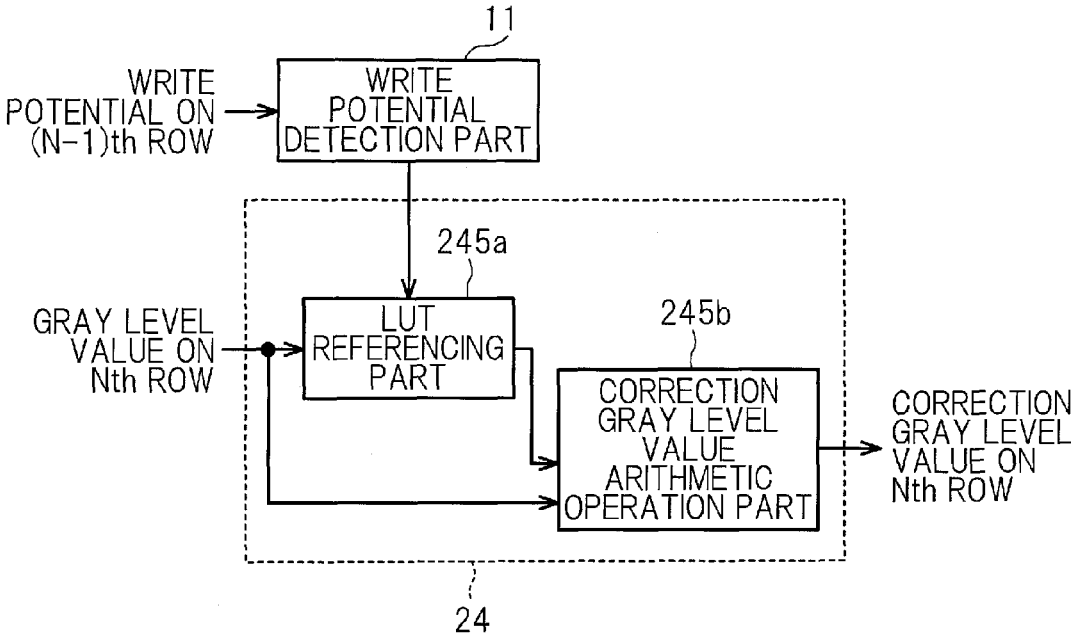
FIG. 15 is a block diagram showing the constitution of a correction part of the second embodiment.

FIG. 15 is a view which conceptually explains the constitution of the correction part 24 of the liquid crystal display device 2 according to the second embodiment. As shown in the drawing, the correction part 24 acquires the correction gray level value $P_N+\Delta P_N$ by receiving the gray level value $P_N$ of the pixel on the Nth row and a write potential of the pixel on the (N−1)th row which is on the same column as the target pixel as inputs.

To be more specific, firstly, the write potential detection part 11 detects a write potential of the pixel on the (N−1)th row from the detection pixels, and inputs the write potential into the correction part 24 as detection data. An LUT referencing part 245*a* acquires the correction amount $\Delta P_N$ by referencing an LUT in which the gray level value $P_N$ of the pixel on the Nth row, a detection result of the pixel on the (N−1)th row and the correction amount $\Delta P_N$ are associated with each other. Then, the correction gray level value arithmetic operation part 245*b* acquires the correction gray level value $P_N+\Delta P_N$ by summing up the correction amount $\Delta P_N$ and the gray level value $P_N$. In this manner, by reflecting the detection data on the write potential detection part 11 to a correction gray level signal voltage, it is possible to make the potential $V_S$ of a pixel electrode stable in an ON voltage outputting period even when an image signal voltage outputting period becomes short.

Modification 1 of Second Embodiment

Figure 16:
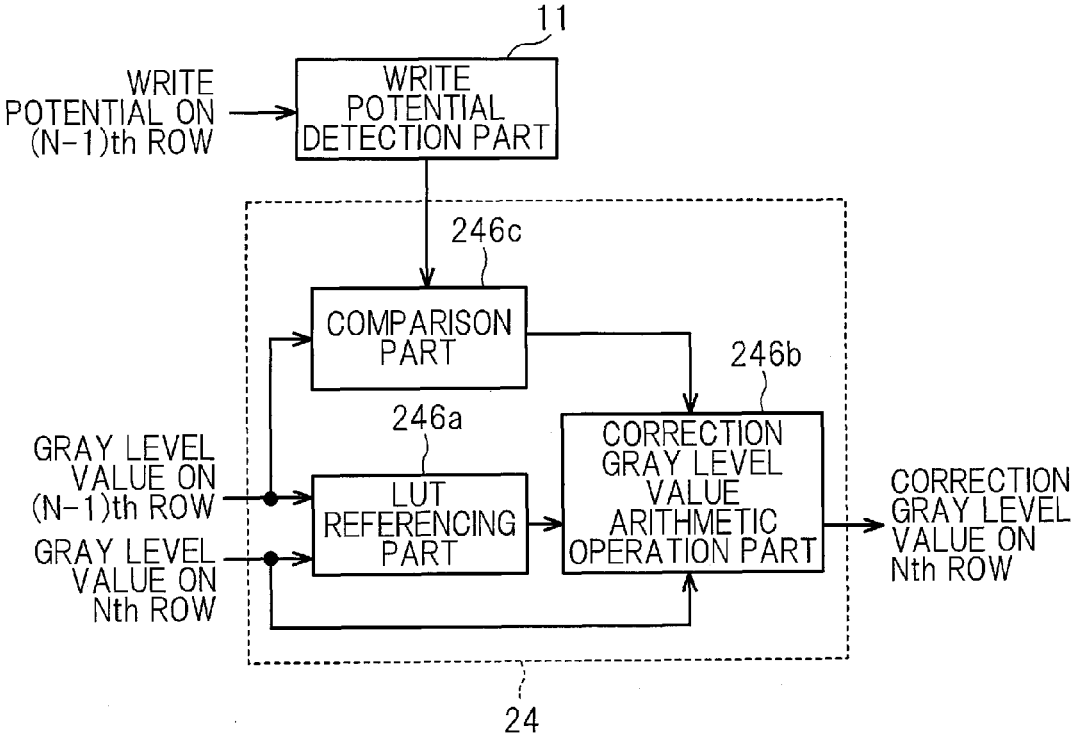
FIG. 16 is a block diagram showing the constitution of a correction part of a modification 1 of the second embodiment.

FIG. 16 conceptually shows the constitution of the correction part 24 of the modification 1 of the second embodiment. Except for the constitution of the correction part 24, the constitution of the liquid crystal display device of the modification 1 of the second embodiment is substantially equal to the constitution of the liquid crystal display device of the second embodiment and hence, the explanation of the constitution other than the constitution of the correction part 24 is omitted.

As shown in FIG. 16, the correction part 24 further includes a comparison part 246*c*, and a write potential of the pixel on the (N−1)th row and the gray level value $P_{N-1}$ of the pixel on the (N−1) th row are inputted to the comparison part 246*c*. A comparison result (d) of these inputs corresponds to the difference between a potential corresponding to a target gray level value and the write potential. On the other hand, an LUT referencing part 246*a* acquires the correction amount $\Delta P_N$ corresponding to two inputs by referencing an LUT in which the gray level value $P_N$ of the pixel on the Nth row, the gray level value $P_{N-1}$ of the pixel on the (N−1)th row and the correction amount $\Delta P_N$ are associated with each other. Then, a correction gray level value arithmetic operation part 246*b* receives the correction amount $\Delta P_N$ and the gray level value $P_N$ of the pixel on the Nth row as inputs, and reflects the difference of the comparison result on the (N−1)th row (for example, setting the correction gray level value of the pixel on the Nth row to $P_N+\Delta P_N+d$ or $P_N+\Delta P_N+d\times 2$) at the time of adding the correction amount $\Delta P_N$ and the gray level value $P_N$ of the pixel on the Nth row thus surely adjusting the potential $V_S$ of the pixel electrode to a target potential.

Figure 17:
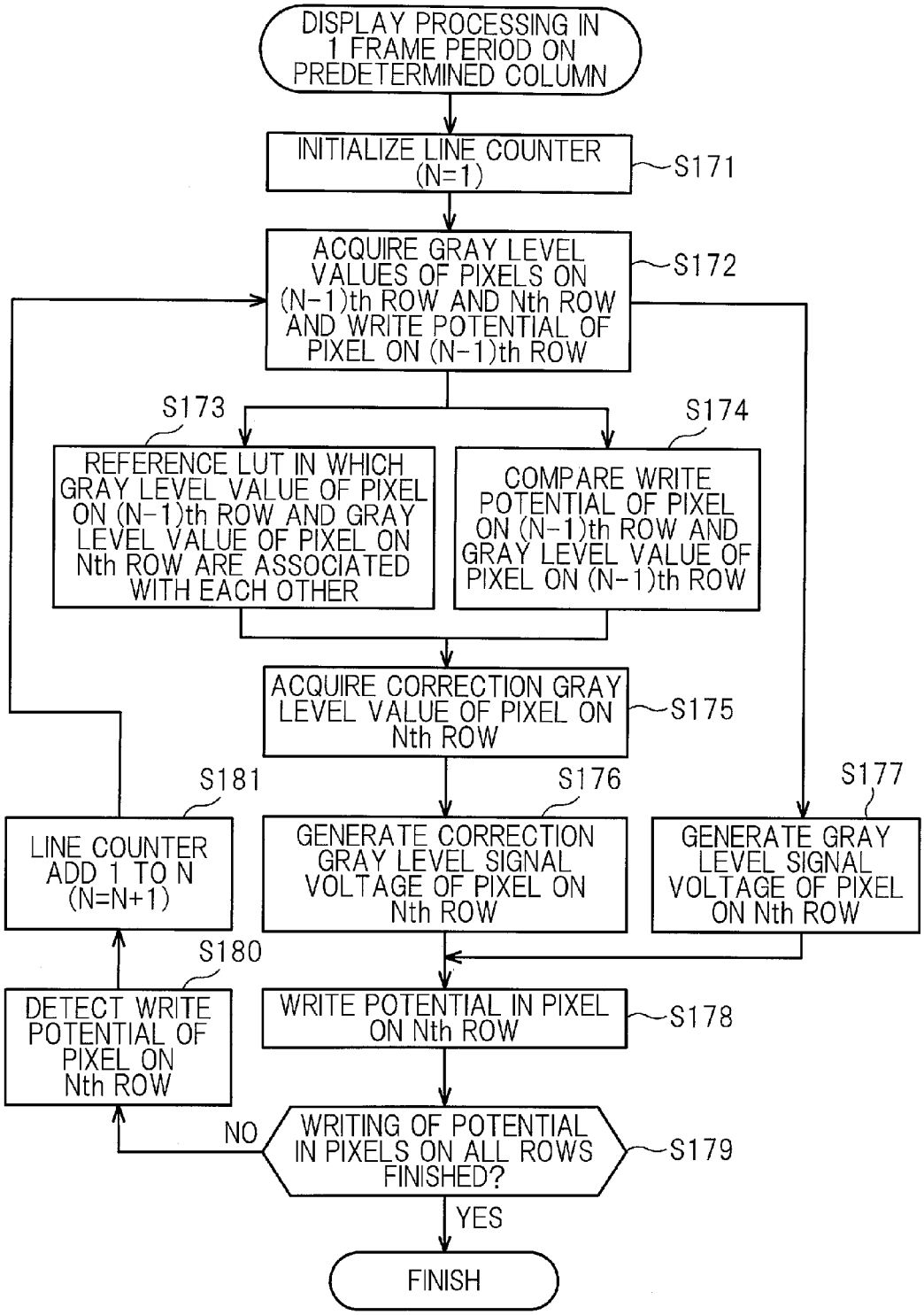
FIG. 17 is a control flowchart of display processing in a 1 frame period in the modification 1 of the second embodiment.

FIG. 17 is a control flowchart of display processing in a 1 frame period in the modification 1 of the second embodiment.

When the display processing is started, firstly, the line counter is initialized (S171). Next, the correction part 24 acquires gray level values of the pixels on the (N−1)th row to the Nth row and a write potential of the pixel on the (N−1)th row (S172). When N is set to 1 (N=1), the correction part 24 may acquire 0 as initial setting values of the gray level value and the write potential of the pixel on the (N−1)th row. Thereafter, the correction part 24 acquires the correction amount $\Delta P_N$ by referencing the LUT (S173), and compares the write potential of the pixel on the (N−1)th row and the gray level value of the pixel on the (N−1)th row (S174). Then, in step S175, the correction part 24 acquires the correction gray level value of the pixel on the Nth row by reflecting the comparison result in step S174. Based on this correction gray level value, the correction gray level signal voltage generation part 26 generates a correction gray level signal voltage (S176). On the other hand, the gray level signal voltage generation part 20 generates the gray level signal voltage V based on the gray level value $P_N$ acquired in step S172 (S177). Due to such operations, the correction gray level signal voltage is outputted in the second period of the image signal voltage outputting period, and the gray level signal voltage is outputted in the first period of the image signal voltage outputting period so that the potential is written in the pixel on the Nth row (S178).

After S178, the correction part 24 determines whether or not the writing of the potential in the pixels on all rows is finished (S179). When the writing of the potential in the pixels on all rows is not finished, the write potential detection part 11 detects a write potential of the pixel on the Nth row (S180). Thereafter, the line counter adds 1 to N (S181), and the correction part 24 repeats the processing in steps S172 to S178 again. When the writing of the potential in the pixels on all rows is finished, the display processing in 1 frame period is finished.

Modification 2 of Second Embodiment

Figure 18:
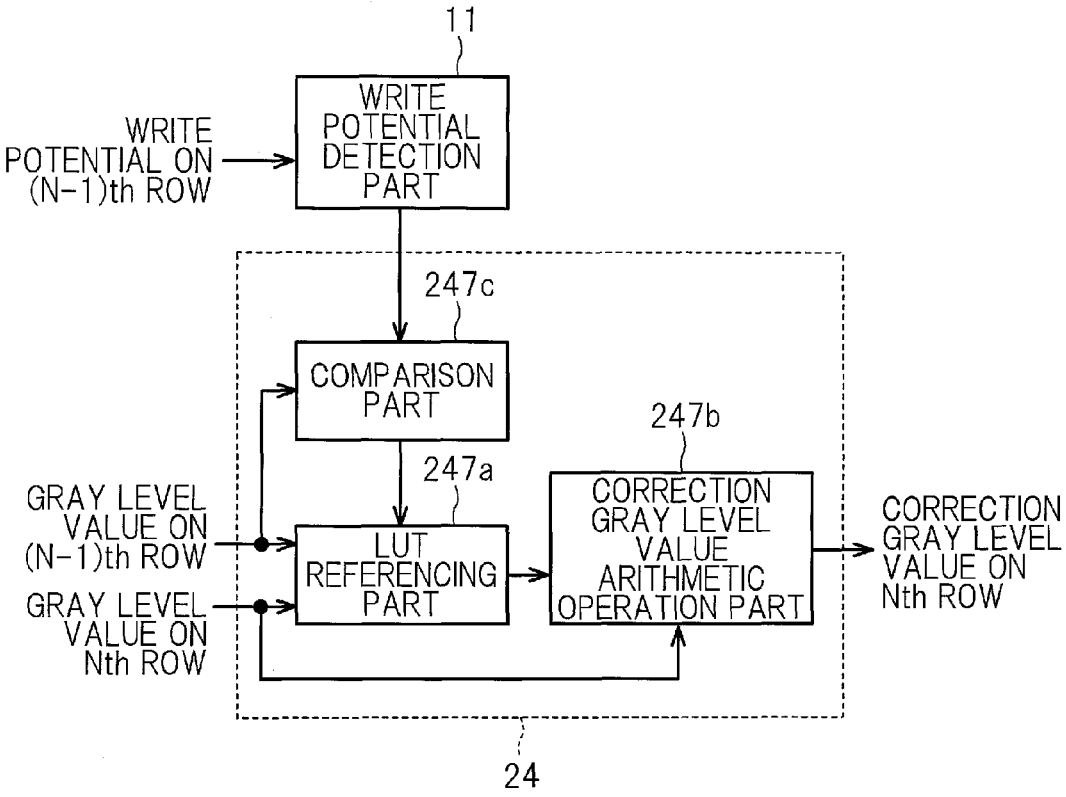
FIG. 18 is a block diagram showing the constitution of a correction part of a modification 2 of the second embodiment.

FIG. 18 conceptually shows the constitution of the correction part 24 of the modification 2 of the second embodiment. Except for the constitution of the correction part 24, the constitution of the liquid crystal display device of the modification 2 of the second embodiment is substantially equal to the constitution of the liquid crystal display device of the second embodiment and hence, the explanation of the constitution other than the constitution of the correction part 24 is omitted.

As shown in FIG. 18, the correction part 24 further includes a comparison part 247*c*, and a write potential of the pixel on the (N−1)th row and the gray level value $P_{N-1}$ of the pixel on the (N−1)th row are inputted to the comparison part 247*c*. A comparison result (d) of these two inputs corresponds to the difference between a potential corresponding to a target gray level value and the write potential. In the modification 2, the comparison result obtained by the comparison part 247*c* is used for updating an LUT to be referenced by an LUT referencing part 247*a*. On the other hand, the LUT referencing part 247*a* acquires the correction amount $\Delta P_N$ based on two inputs by referencing the LUT in which the gray level value $P_N$ of the pixel on the Nth row, the gray level value $P_{N-1}$ of the pixel on the (N−1)th row and the correction amount $\Delta P_N$ are associated with each other. A correction gray level value arithmetic operation part 247*b* acquires the correction gray level value $P_N+\Delta P_N$ of the pixel on the Nth row by receiving two inputs consisting of the correction amount $\Delta P_N$ and the gray level value $P_N$ of the pixel on the Nth row. Since the LUT used for outputting the correction amount $\Delta P_N$ is updated based on detection data obtained by the write potential detection part 11, the potential $V_S$ of the pixel electrode can be surely adjusted to a target potential.

Figure 19:
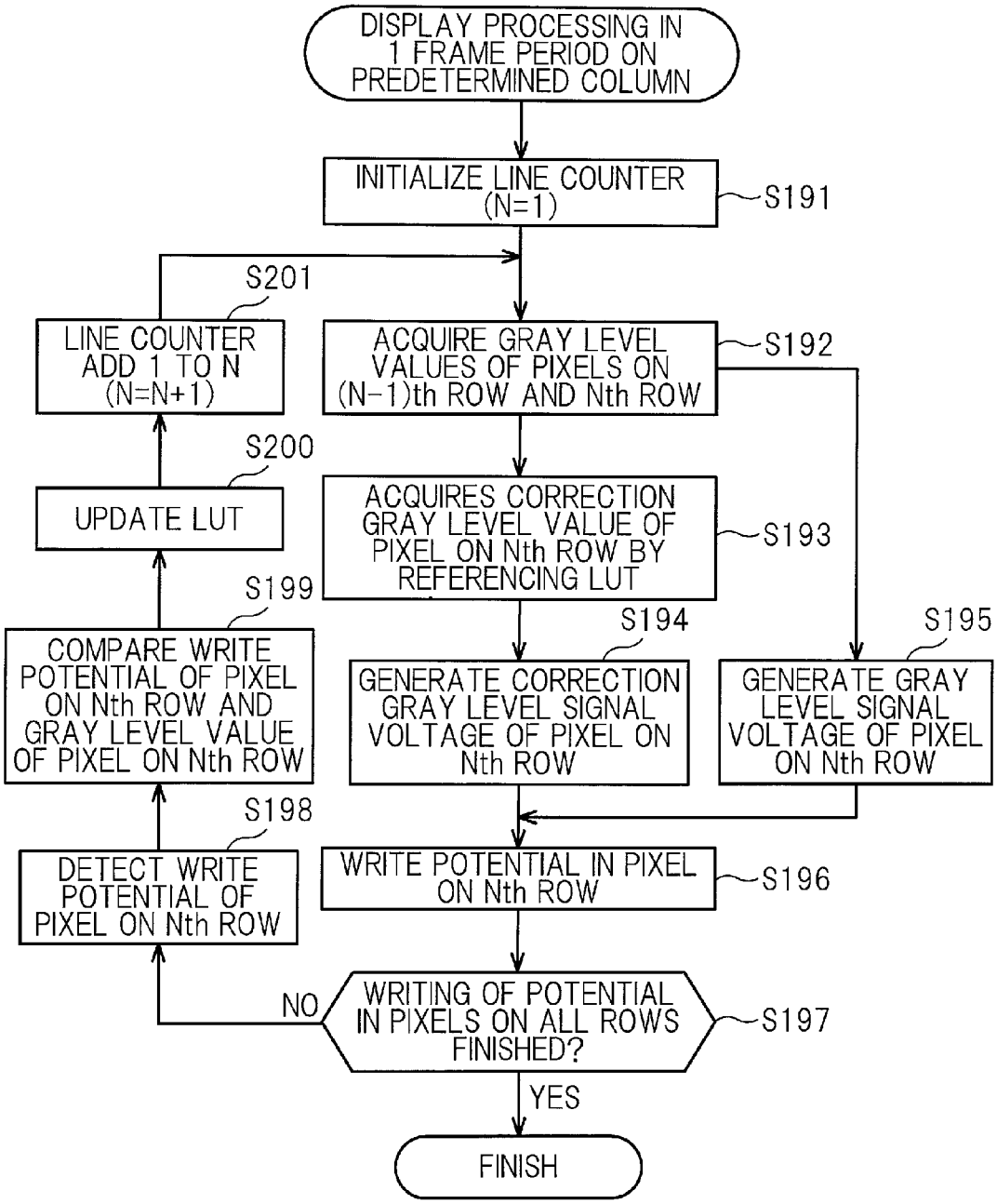
FIG. 19 is a control flowchart of display processing in a 1 frame period in the modification 2 of the second embodiment.

FIG. 19 is a control flowchart of display processing in a 1 frame period in the modification 2 of the second embodiment.

When the display processing is started, firstly, the line counter is initialized (S191). Next, the correction part 24 acquires gray level values of the pixels on the (N−1)th row to the Nth row (S192). Here, when N is set to 1 (N=1), the correction part 24 may acquire 0 as initial setting values of the gray level value and the write potential of the pixel on the (N−1)th row. Thereafter, the correction part 24 acquires the correction gray level value $P_N+\Delta P_N$ of the pixel on the Nth row by referencing the LUT (S193). The correction gray level signal voltage generation part 26 generates the correction gray level signal voltage $V+\Delta V$ (S194). On the other hand, the gray level signal voltage generation part 20 generates the gray level signal voltage V based on the gray level value $P_N$ acquired in step S192 (S195). A potential is written in the pixel on the Nth row based on the acquired correction gray level signal voltage and gray level signal voltage (S196).

After step S196, the correction part 24 determines whether or not the writing of the potential in the pixels on all rows is finished (S197). When the writing of the potential in the pixels on all rows is not finished, the write potential detection part 11 detects a write potential of the pixel on the Nth row (S198), and compares the write potential of the pixel on the Nth row and the gray level value $P_N$ (S199). Then, the LUT is updated by reflecting the comparison result on the LUT (S200), and the line counter adds 1 to N (S201). Due to such processing, processing in steps S192 to S196 is repeated again. Here, the LUT used in step S193 is updated based on detection data on the write potential in step S200 and hence, the difference between the gray level value of the pixel and the detection value of the write potential can be made small so that the potential $V_S$ of the pixel electrode can be surely adjusted to the target potential. When the line counter reaches a predetermined value and the writing of the potential in the pixels on all rows is finished, the display processing in 1 frame period is finished.

Third Embodiment

Figure 20:
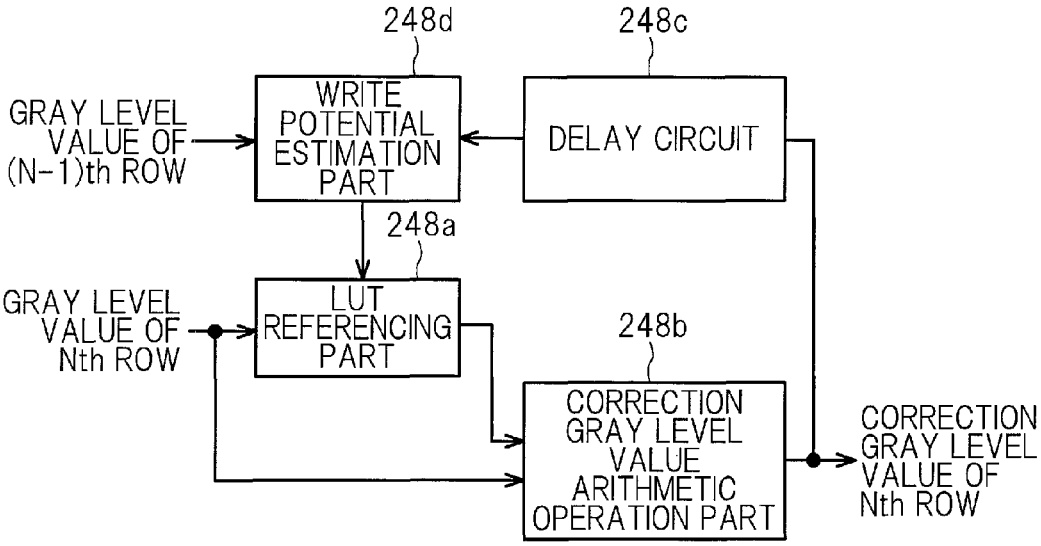
FIG. 20 is a block diagram showing the constitution of a correction part of a third embodiment.

Next, a liquid crystal display device according to the third embodiment of the present invention is explained. FIG. 20 conceptually shows the constitution of the correction part 24 of the liquid crystal display device according to the third embodiment. Except for the constitution of the correction part 24, the constitution of the liquid crystal display device of the third embodiment is substantially equal to the constitution of the liquid crystal display device of the first embodiment. Accordingly, the explanation of parts substantially equal to the corresponding parts of the first embodiment is omitted when appropriate.

As shown in FIG. 20, the correction part 24 further includes a write potential estimation part 248*d* which estimates a potential written in the pixel on the (N−1)th row. The gray level value $P_{N-1}$ and the correction gray level value $P_{N-1}+\Delta P_{N-1}$ of the pixel on the (N−1)th row are inputted to the write potential estimation part 248*d*. The correction gray level value $P_{N-1}+\Delta P_{N-1}$ is inputted to the write potential estimation part 248*d* through a delay circuit 248*c*. The write potential estimation part 248*d* estimates the potential written in the pixel on the (N−1)th row based on these two inputs. To be more specific, the write potential estimation part 248*d* reads out an LUT in which the gray level value $P_{N-1}$, the correction gray level value $P_{N-1}+\Delta P_{N-1}$ and a result of write potential estimation are associated with each other from a storage unit, and outputs the estimation result of the write potential associated with two inputs.

Then, an LUT referencing part 248*a* references an LUT in which the gray level value $P_N$ of the pixel on the Nth row, the estimation result of the write potential of the pixel on the (N−1)th row and the correction amount $\Delta P_N$ are associated with each other, and outputs the correction amount $\Delta P_N$ associated with two inputs. Further, a correction gray level arithmetic operation part 248*b* outputs the correction gray level value $P_N+\Delta P_N$ of the pixel on the Nth row after summing up the correction amount $\Delta P_N$ and the gray level value $P_N$ of the pixel on the Nth row.

In the third embodiment, a correction gray level signal voltage of the pixel on the Nth row is generated based on the gray level value $P_N$ of the pixel on the Nth row, the gray level value $P_{N-1}$ of the pixel on the (N−1)th row and the correction gray level value $P_{N-1}+\Delta P_{N-1}$ of the pixel on the (N−1)th row. Since the correction gray level value $P_{N-1}+\Delta P_{N-1}$ of the pixel on the (N−1)th row is generated based on the gray level value of the pixel which precedes the pixel on the (N−1)th row in order, it is safe to say that the correction gray level signal voltage outputted during an image signal voltage outputting period with respect to the pixel on the Nth row is generated based on a plurality of pixels on or before the (N−1)th row.

Modification 1 of Third Embodiment

Figure 21:
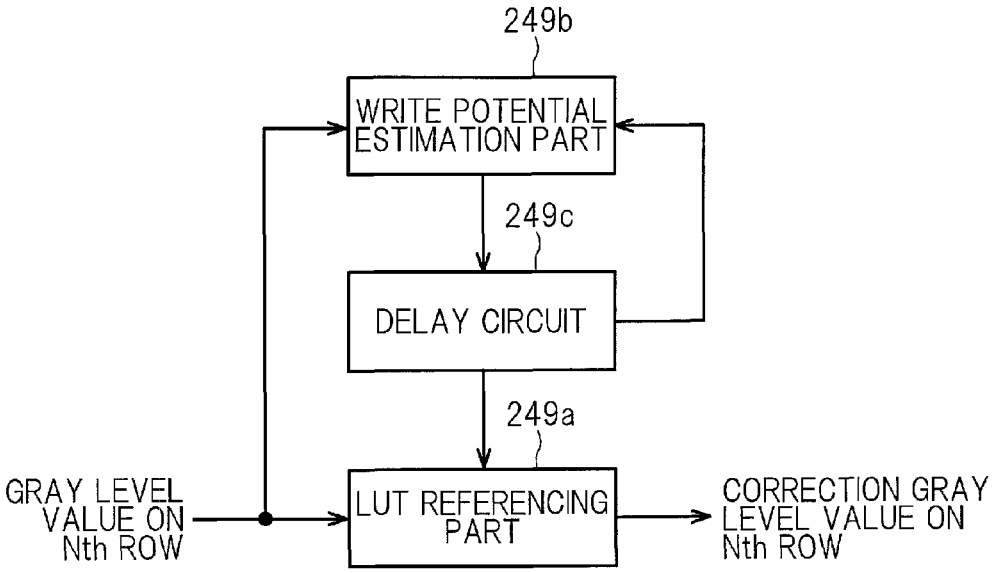
FIG. 21 is a block diagram showing the constitution of a correction part of a modification 1 of the third embodiment.

Next, FIG. 21 conceptually shows the constitution of the correction part 24 of the modification 1 of the third embodiment. Except for the constitution of the correction part 24, the constitution of the liquid crystal display device of the modification 1 of the third embodiment is substantially equal to the constitution of the liquid crystal display device of the third embodiment and hence, the explanation of the constitution other than the constitution of the correction part 24 is omitted.

As shown in FIG. 21, the gray level value of the pixel on the Nth row is inputted to an LUT referencing part 249*a* and a write potential estimation part 249*b*. Further, an estimation result is again inputted to the write potential estimation part 249*b* by a delay circuit 249*c* by a feedback. Accordingly, a write potential estimation result of the pixel on the (N−1)th row is inputted to the write potential estimation part 249*b* together with the gray level value $P_N$ of the pixel on the Nth row. To be more specific, the write potential estimation part 249*b* outputs the write potential estimation result of the pixel on the Nth row based on two inputs by referencing an LUT in which the gray level value $P_N$ of the pixel on the Nth row, the write potential estimation result of the pixel on the (N−1)th row and the write potential estimation result of the pixel on the Nth row are associated with each other. The outputted write potential estimation result of the pixel on the Nth row is inputted to the LUT referencing part 249*a* through the delay circuit 249*c*. Accordingly, when the gray level value $P_N$ of the pixel on the Nth row is inputted to the LUT referencing part 249*a*, the write potential estimation result on the (N−1)th row through the delay circuit 249*c* is inputted to the LUT referencing part 249*a*.

Then, the LUT referencing part 249*a* acquires the correction gray level value $P_N+\Delta P_N$ based on two inputs by referencing an LUT in which the gray level value $P_N$ of the pixel on the Nth row, the write potential estimation result of the pixel on the (N−1)th row and the correction gray level value $P_N+\Delta P_N$ are associated with each other.

In the modification 1 of the third embodiment, the correction gray level signal voltage of the pixel on the Nth row is generated based on the gray level value of the pixel on the Nth row and the write potential estimation result of the pixel on the (N−1)th row. Then, the write potential estimation result of the pixel on the (N−1)th row is outputted based on the gray level value of the pixel on the (N−1)th row and the write potential estimation result of the pixel on the (N−2)th row. Accordingly, it is safe to say that the correction gray level signal voltage of the pixel on the Nth row is generated based on not only the gray level value $P_N$ of the pixel on the Nth row and the gray level value $P_{N-1}$ of the pixel on the (N−1)th row but also gray level values of a plurality of pixels which precede the pixel on the Nth row.

Embodiments of the present invention are not limited to the above-mentioned embodiments.

When a gray level value of a target pixel is "255" and a gray level value of a pixel which is one pixel above the target pixel (that is, a gray level value of a one-pixel preceding pixel before the target pixel in order) is "0", a correction gray level signal voltage is set as follows, for example. To be more specific, when the gray level value "255" assumes plus polarity with respect to the potential $V_{COM}$ of the common electrode 16, the correction gray level signal voltage $V+\Delta V$ may be set to a voltage which exceeds a voltage corresponding to the gray level value "255" indicative of a maximum gray level. To the contrary, when the gray level value "255" assumes minus polarity with respect to the potential of the common electrode 16, the correction gray level signal voltage $V+\Delta V$ may be set to a voltage lower than a voltage corresponding to the gray level value "255".

Further, when a gray level value of the target pixel is "0" and a gray level value of the pixel which is one pixel above the target pixel is "255", a correction gray level signal voltage is set as follows, for example. To be more specific, when the gray level value of the pixel which is one pixel above the target pixel assumes positive polarity with respect to the potential $V_{COM}$, the correction gray level signal voltage may be set to a potential lower than the potential of the common electrode 16, or may be set to a potential within a range from a potential corresponding to the gray level value "0" to a potential corresponding to the gray level value "255" which assumes negative polarity at the time of frame inversion. To the contrary, when the gray level value of the pixel which is one pixel above the target pixel assumes negative polarity with respect to the potential $V_{COM}$, the correction gray level signal voltage may be set to a potential higher than the potential of the common electrode 16, or may be set to a potential within a range from the potential corresponding to the gray level value"0" to the potential corresponding to the gray level value "255" which assumes positive polarity at the time of frame inversion. That is, the correction gray level signal voltage $V+\Delta V$ may be set to a voltage having polarity different from polarity of the voltage corresponding to the gray level value "255" of the pixel which is one pixel above the target pixel.

Further, in the above-mentioned respective embodiments, the scanning line drive part 8 starts outputting of an ON voltage to the scanning line $GL_N$ when an image signal voltage corresponding to the pixel positioned on the (N−2)th row which precedes the Nth row by 2 rows is outputted by the data line drive part 6. However, it is needless to say that such outputting of the ON voltage to the scanning line $GL_N$ may be started when an image signal voltage corresponding to the pixel which precedes the Nth row by one or more rows is outputted.

Further, instead of generating the correction gray level signal voltage based on the gray level value $P_N$ of the target pixel as described in the above-mentioned embodiments, the correction gray level signal voltage may be generated based on the gray level signal voltage of the target pixel. Also in this case, it is safe to say that the correction gray level signal voltage is generated based on the gray level value.

Further, for example, the data line drive part 6 may output an image signal voltage of the pixel positioned on the first row and also an image signal voltage of the pixel positioned on the second row for a period longer than a period for outputting an image signal voltage to pixels positioned on other rows. For example, when a refresh rate is high, an image signal voltage outputting period in which an image signal voltage of a pixel positioned on a row other than the first row or the second row is outputted may be set to ½ of an image signal voltage outputting period in which an image signal voltage of a pixel positioned on the first row or the second row is outputted. In this case, the control part 4 may control the data line drive part 6 such that the image signal voltage of the pixel positioned on the first row or the second row is outputted for a longer period than the image signal voltage of the pixel positioned in other row.

Further, in the above-mentioned embodiments, by adjusting the correction gray level signal voltage V+ΔV outputted in the second period, the potential $V_S$ of the pixel electrode is made stable thus making the writing deficiency hardly occur. However, the potential $V_S$ of the pixel electrode may be stable by controlling a period in which the correction gray level signal voltage V+ΔV is outputted (by controlling a length of the second period).

In the above-mentioned respective embodiments, the IPS (In Plane Switching) method is adopted as a driving method of a liquid crystal display device. However, other methods such as a VA (Vertically Aligned) method or a TN (Twisted Nematic) method may be also adopted as a driving method. The present invention can be suitably modified by those who are skilled in the art without departing from the technical concept of the present invention.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device comprising:

one image signal line to which drain electrodes of thin-film transistors respectively included in a plurality of pixels are connected, each of the plurality of pixels including a pixel electrode and one of the thin film transistors which has a source electrode thereof connected to the pixel electrode;

a plurality of scanning lines respectively connected to gate electrodes of the thin film transistors included in the plurality of pixels connected to the one image signal line, an output unit which is configured to output ON voltage for turning on the thin film transistors through the plurality of scanning lines in a predetermined order; and an image signal output unit which is configured to output image signal voltages corresponding to the plurality of pixels through the image signal line in the predetermined order; wherein the image signal output unit outputs a gray level signal voltage having a voltage corresponding to a gray level value of the pixel as an image signal voltage of the pixel in a first period out of a period in which the image signal voltage of the pixel is outputted, and outputs a correction gray level signal voltage having a voltage different from the gray level signal voltage as an image signal voltage of the pixel in a second period which precedes the first period out of the period, the plurality of pixels include a first pixel connected to one scanning line in the plurality of scanning lines, a second pixel to which the ON voltage is input one pixel before the first pixel in the predetermined order, and a third pixel to which the ON voltage is input one pixel before the second pixel in the predetermined order;

the liquid crystal display device further comprises a control unit configured to generate the correction gray level signal voltage of the plurality of pixels, the control unit generating the correction gray level signal voltage of the first pixel based on the gray level value of the first pixel and one or plurality of gray level values of pixels which precede the first pixel in the predetermined order; and wherein the control unit comprises:

a correction unit which is configured to output the correction gray level value of the first pixel, based on the gray level value of the first pixel, a gray level value of the second pixel, and a correction gray level value of the second pixel, and a correction gray level signal voltage generation unit which is configured to generate the correction gray level signal voltage based on the correction gray level value outputted from the correction unit, wherein the correction gray level value of the second pixel is outputted based on at least two of gray level values of pixels comprised of the second pixel and the third pixel.

2. The liquid crystal display device according to claim 1, wherein the output unit is configured to start the outputting of the ON voltage to the first pixel when the image signal output unit outputs the image signal voltage corresponding to a pixel to which the ON voltage is input by one or more pixels before the first pixel in the predetermined order.

3. The liquid crystal display device according to claim 1, wherein the correction unit is configured to output a correction amount based on the gray level values of the second pixel and the third pixel by referencing a first lookup table in which the gray level values of the second pixel and the third pixel and the correction amount are associated with each other, the correction unit is configured to also output the correction gray level value of the first pixel by referencing a second lookup table in which the gray level value of the first pixel, the correction amount and the correction gray level value of the first pixel are associated with each other, and the correction amount is smaller than the correction gray level value of the first pixel in data size.

4. The liquid crystal display device according to claim 1, further comprising a detection unit which is configured to detect a potential written in the pixel electrode, wherein the control unit generates the correction gray level signal voltage of the first pixel based on the gray level value of the first pixel, and a potential written in the pixel electrode of the second pixel.

5. The liquid crystal display device according to claim 4, wherein the control unit generates the correction gray level signal voltage of the first pixel based on a result of comparison between the gray level value of the second pixel and the potential written in the pixel electrode of the second pixel.

6. The liquid crystal display device according to claim 5, wherein the control unit generates the correction gray level signal voltage by referencing at least one lookup table, and the control unit includes an updating unit which is configured to update the lookup table based on the result of the comparison.

7. The liquid crystal display device according to claim 1, wherein the correction unit includes an estimation unit which is configured to estimate a potential written in the pixel electrode of the first pixel based on the gray level value of the first pixel, and the correction unit which is configured to generate the correction gray level value of the first pixel based on the gray level value of the first pixel and a potential of the second pixel in order before the pixel which has the potential estimated by the estimation unit.

8. The liquid crystal display device according to claim 7, wherein the estimation unit estimates the potential written in the pixel electrode of the first pixel by referencing a lookup table in which the gray level value of the first pixel, the correction gray level value of the first pixel and the potential written in the pixel electrode of the first pixel are associated with each other.

9. The liquid crystal display device according to claim 1, wherein the output unit is configured to start the outputting of the ON voltage to the first pixel when the image signal output unit outputs the image signal voltage corresponding to a pixel to which the ON voltage is input two or more pixels before the first pixel in the predetermined order.

* * * * *